US010674881B2

(12) United States Patent
Chavana, Jr. et al.

(10) Patent No.: US 10,674,881 B2
(45) Date of Patent: Jun. 9, 2020

(54) LIQUID EXTRACTION APPARATUS AND METHOD

(71) Applicant: Rug Doctor, LLC, Plano, TX (US)

(72) Inventors: Ernest Matthew Chavana, Jr., Villa Ridge, MO (US); Richard Foster, Powell, OH (US); Stanley Anderson, Fenton, MO (US); Christopher Terpstra, Frisco, TX (US); Jan Valentic, Plano, TX (US); Xintao Ma, Suzhou (CN)

(73) Assignee: RUG DOCTOR, LLC, Plano, TX (US)

( * ) Notice: Subject to any disclaimer, the term of this patent is extended or adjusted under 35 U.S.C. 154(b) by 148 days.

(21) Appl. No.: 15/709,010

(22) Filed: Sep. 19, 2017

(65) Prior Publication Data

US 2019/0082905 A1 Mar. 21, 2019

(51) Int. Cl.
*A47L 7/00* (2006.01)
*A47L 9/32* (2006.01)
(Continued)

(52) U.S. Cl.
CPC ..... *A47L 7/0019* (2013.01); *A47L 5/365* (2013.01); *A47L 7/0009* (2013.01);
(Continued)

(58) Field of Classification Search
CPC ..... A47L 7/0019; A47L 5/365; A47L 7/0009; A47L 7/0014; A47L 7/0028;
(Continued)

(56) References Cited

U.S. PATENT DOCUMENTS 5,799,362 A * 9/1998 Huffman ..... A47L 1/08 15/321
2004/0088817 A1* 5/2004 Cochran ..... A47L 5/14 15/327.5

(Continued)

FOREIGN PATENT DOCUMENTS

EP 0719516 * 7/1996
EP 0719516 A2 7/1996

(Continued)

OTHER PUBLICATIONS

Extended European Search Report dated Sep. 6, 2019, in connection with counterpart European Patent Application No. 18195017.1.

(Continued)

*Primary Examiner* — Robert J Scruggs
(74) *Attorney, Agent, or Firm* — Hauptman Ham, LLP

(57) ABSTRACT

An apparatus comprises a body, a first tank, a second tank, a vacuum motor, a fluid pump, and a controller. The body comprises a handle and an accessory connection receptacle comprising a fluid output and an electrical contact. The first tank comprises a first vessel configured to accommodate a fluid. The second tank comprises a second vessel separated from the first vessel. The controller is configured to activate the fluid pump to cause fluid contained in the first tank to be supplied to the fluid output, and to activate the vacuum motor to draw one or more of air, debris, a liquid or a portion of the fluid into the second tank. The accessory connection receptacle is configured to accommodate a correspondingly shaped accessory connector configured to mate with the accessory connection receptacle and be communicatively coupled with the fluid output and with the electrical contact.

18 Claims, 18 Drawing Sheets

(51) Int. Cl.

| | |
|---|---|
| ***A47L 5/36*** | (2006.01) |
| ***A47L 9/00*** | (2006.01) |
| ***A47L 9/28*** | (2006.01) |
| ***A47L 9/30*** | (2006.01) |
| ***A47L 9/24*** | (2006.01) |
| ***A47L 9/04*** | (2006.01) |
| ***A47L 11/34*** | (2006.01) |
| ***A47L 11/20*** | (2006.01) |
| ***A47L 11/40*** | (2006.01) |
| ***A47L 11/30*** | (2006.01) |

(52) U.S. Cl.

CPC ..... *A47L 7/0014* (2013.01); *A47L 7/0028* (2013.01); *A47L 7/0038* (2013.01); *A47L 7/0042* (2013.01); *A47L 9/0018* (2013.01); *A47L 9/0027* (2013.01); *A47L 9/0036* (2013.01); *A47L 9/0411* (2013.01); *A47L 9/0466* (2013.01); *A47L 9/246* (2013.01); *A47L 9/2842* (2013.01); *A47L 9/2847* (2013.01); *A47L 9/2857* (2013.01); *A47L 9/30* (2013.01); *A47L 9/327* (2013.01); *A47L 11/201* (2013.01); *A47L 11/302* (2013.01); *A47L 11/34* (2013.01); *A47L 11/4016* (2013.01); *A47L 11/4083* (2013.01); *A47L 11/4088* (2013.01)

(58) Field of Classification Search

CPC .... A47L 7/0038; A47L 7/0042; A47L 9/0018; A47L 9/0027; A47L 9/0036; A47L 9/0411; A47L 9/0466; A47L 9/246; A47L 9/2842; A47L 9/2847; A47L 9/2857; A47L 9/30; A47L 9/327; A47L 11/34; A47L 11/4044; A47L 11/4088; A47L 11/4083; A47L 11/30; A47L 7/00

See application file for complete search history.

(56) References Cited

U.S. PATENT DOCUMENTS

| | | | | |
|---|---|---|---|---|
| 2006/0288518 | A1* | 12/2006 | Lenkiwicz | A47L 9/0036 15/322 |
| 2012/0222251 | A1* | 9/2012 | Conrad | A47L 9/0018 15/347 |
| 2013/0318741 | A1 | 12/2013 | Moyher, Jr. et al. | |
| 2015/0245750 | A1 | 9/2015 | Wall et al. | |
| 2015/0245757 | A1* | 9/2015 | Wall | A47L 11/4088 15/321 |
| 2016/0066513 | A1* | 3/2016 | Gray | A01G 20/43 134/21 |
| 2016/0281882 | A1* | 9/2016 | Zimmerman | E02F 9/2275 |
| 2017/0127900 | A1* | 5/2017 | Wright | A47L 11/30 |

FOREIGN PATENT DOCUMENTS

| | | | |
|---|---|---|---|
| EP | 0836828 | A2 | 4/1998 |
| JP | S54-031371 | U | 3/1979 |
| JP | S62-253020 | A | 11/1987 |
| JP | H08-035216 | A | 2/1996 |
| JP | H08-196484 | A | 8/1996 |
| JP | 2015-521208 | A | 6/2010 |

OTHER PUBLICATIONS

Japanese Office Action dated Oct. 23, 2019, in connection with the Japanese Patent Application No. 2018-151379.

* cited by examiner

LIQUID EXTRACTION APPARATUS AND METHOD

BACKGROUND

Device manufacturers and service providers are continually challenged to develop cleaning systems capable of providing value and convenience to consumers. Conventional floor cleaning systems are often intimidating to consumers and offer limited flexibility.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
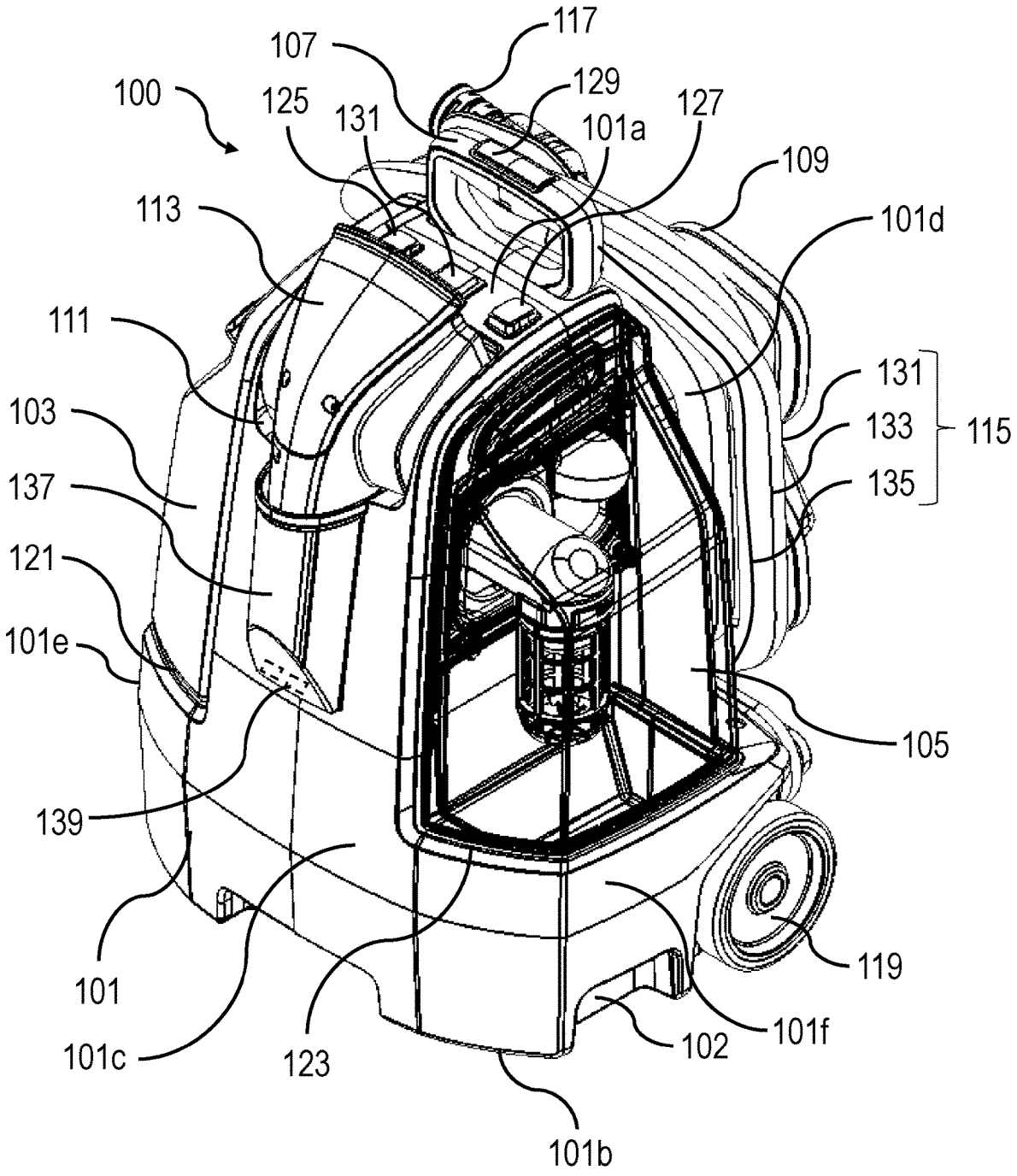
FIG. 1 is a perspective view of an apparatus, in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the location of a first feature over or on a second feature in the description that follows may include embodiments in which the first and second features are in direct contact, and may also include embodiments in which additional features may be between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Conventional liquid extraction devices are often large, bulky, and otherwise intimidating cleaning systems that consumers usually have difficulty operating and handling. Conventional cleaning systems are often limited as to how the components of the cleaning system can be manipulated by a consumer, making transport, maneuverability and service difficult.

FIG. 1 is a perspective view of an apparatus 100, in accordance with some embodiments. Apparatus 100 comprises a body 101, a cleaning fluid tank 103, a recovery tank 105, a handle 107, and a hose rack 109. Apparatus 100 optionally includes one or more of an accessory attachment cradle 111 on or incorporated in the body 101, an accessory attachment 113, an accessory connection package 115, an accessory handgrip 117, or wheels 119.

Apparatus 100 is a liquid extraction cleaning system. Body 101 has an upper side 101*a*, a bottom side 101*b*, a front side 101*c*, a back side 101*d*, a left side 101*e* and a right side 101*f*. Body 101 comprises one or more sidewalls that define the upper side 101*a*, the bottom side 101*b*, the front side 101*c*, the back side 101*d*, the left side 101*e* and the right side 101*f*, and at least one cavity therein. In some embodiments, the body 101 comprises one or more panels that comprise one or more sidewalls that define the upper side 101*a*, the bottom side 101*b*, the front side 101*c*, the back side 101*d*, the left side 101*e* and the right side 101*f* of body 101. In some embodiments, one or more of the panels comprise at least one recessed portion 102 configured to be usable as an area to grip body 101.

Each of cleaning fluid tank 103 and recovery tank 105 is inserted into a corresponding cleaning fluid tank seat 121 or recovery tank seat 123 on body 101. Each of the cleaning fluid tank 103 and the recovery tank 105 is communicatively coupled with a corresponding portion of body 101.

Body 101 is configured to cooperate with at least one of cleaning fluid tank 103 or recovery tank 105 to removably secure cleaning fluid tank 103 or recovery tank 105 to the body 101. In some embodiments, body 101 comprises a locking mechanism 125 configured to secure cleaning fluid tank 103 to body 101. In some embodiments, the locking mechanism 125 comprises one or more of a button, a buckle, a latch, a hook, one or more pins, nubs, hooks, other suitable fastener, or some other suitable structure configured to mate with the cleaning fluid tank 103 to removably secure cleaning fluid tank 103 to body 101. Body 101 comprises a locking mechanism 127 configured to secure recovery tank 105 to body 101. In some embodiments, the locking mechanism 127 comprises one or more of a button, a buckle, a latch, a hook, one or more pins, nubs, hooks, other suitable fastener, or some other suitable structure configured to mate with the recovery tank 105 to removably secure recovery tank 105 to body 101. In some embodiments, body 101 comprises a tank caddy comprising one or more sidewalls of body 101 that are capable of being separated from a remainder of body 101 with cleaning fluid tank 103 and cleaning fluid tank 105 in tank seat 121 and tank seat 123, respectively.

Handle 107 is incorporated within or coupled with a portion of body 101. Handle 107 is between the cleaning fluid tank 103 and the recovery tank 105. Handle 107 is configured to be movable from a collapsed position to an extended position. Handle 107 is illustrated in FIG. 1 in the collapsed position. Handle 107 is configured to be locked in the collapsed position or in the extended position. Handle 107 is configured to facilitate at least one of carrying or positioning of the apparatus 100. In some embodiments, handle 107 includes a release mechanism 129 that is configured to interact with a locking mechanism that holds the handle in the collapsed position or the extended position unless the release mechanism 129 is actuated. In some embodiments, release mechanism 129 comprises a button or other suitable structure on handle 107. In some embodiments, the locking mechanism configured to interact with release mechanism 129 comprises one or more of a hook, a detent, a spring-loaded structure, or other suitable structure capable of interacting with one or more of handle 107 or release mechanism 129 to hold the handle 107 in the collapsed position or in the extended position.

A power button 130 is on body 101. In some embodiments, power button 130 is on upper-side 101*a* of body 101. In some embodiments, power button 130 is on a different portion of body 101. In some embodiments, the power button 130 or a different power button is on handle 107, accessory attachment 113 or accessory handgrip 117. In use, one or more components of body 101 are configured to cause fluid accommodated within cleaning fluid tank 103 to be supplied to a fluid output of body 101. In some embodiments, one or more of accessory attachment 113, accessory connection package 115 or accessory handgrip 117 is communicatively coupled with body 101 to cause fluid accommodated within cleaning fluid tank 103 to be expelled onto a surface external to the body 101 and to facilitate one or more of air, debris, a liquid or a portion of the fluid to be drawn from the surface external to body 101 into the recovery tank 105.

The various embodiments discussed herein improve user confidence in the ability to one or more of transport or operate a liquid extraction apparatus such as apparatus 100. For example, the modular configuration of the apparatus 100 makes transporting the apparatus 100 easier for a user compared to a non-modular liquid extraction system. The accessory attachment 113, accessory connection package 115 and accessory handgrip 117 are capable of being separated from the body 101. Separating the accessory attachment 113, the accessory connection package 115 and accessory handgrip 117 reduces an overall weight of apparatus 100 into at least two portions, making lifting and maneuverability easier for a user.

Additionally, the severability of accessory attachment 113, accessory connection package 115 and accessory handgrip 117 from body 101 makes it possible to couple alterative type of accessories, accessor connection packages, hoses, or handgrips with body 101, or to use the accessory attachment 113, accessory connection package 115 and/or accessory handgrip 117 with another body 101 or other type of extraction system.

In some embodiments, because the overall weight of apparatus 100 is capable of being split into at least two modular portions, the body 101 is capable of housing a larger vacuum motor to increase cleaning performance compared to conventional liquid extraction systems. For example, if a threshold weight for lifting a liquid extraction system is set for a conventional liquid extraction system, suction power is often limited, because increasing the size of the vacuum motor included in the liquid extraction system would usually be met with concerns that the liquid extraction system would be too heavy to lift. Conventional liquid extraction systems often compromise cleaning performance for portability. The severability of accessory attachment 113, accessory connection package 115 and/or accessory handgrip 117 from body 101 makes it possible to overcome the fear that increased suction comes at the cost of increased weight that would make lifting the apparatus 100 difficult for an ordinary user.

Accessory connection package 115 comprises a hose 131, a fluid supply line 133 and a power supply line 135. In some embodiments, accessory connection package 115 includes accessory handgrip 117.

In some embodiments, the one or more panels that define the sides of body 101 are capable of being removed for ease of access to the features housed therein. In some embodiments, one or more of the panels that define the sides of the body 101 are quick-release panels to facilitate easy access for a user to service the apparatus 100. In some embodiments, at least one of the one or more quick-release panels is coupled with another portion of body 101 by one or more fasteners. In some embodiments, the one or more fasteners are capable of being tightened and loosened using a conventional screwdriver, a flathead screwdriver, a Philips head screwdriver, a hex-head screw driver, a torx-head screw driver, or other suitable type of screwdriver head. In some embodiments, all of the quick-release panels that are coupled with the body 101 by a fastener are coupled by a same type of fastener to facilitate ease of access to the body 101 and the components housed therein.

Accessory attachment cradle 111 is a recessed region defined by one or more sidewalls of body 101. In come embodiments, the recessed region has a shape that substantially matches a shape of accessory attachment 113. In some embodiments, the recessed region is at least partially flexible and has at least one portion that is configured flex to receive the accessory attachment 113 and flex to release the accessory attachment 113. In some embodiments, to releasably hold an accessory attachment such as accessory attachment 113. In some embodiments, an accessory cradle cap 137 is removably attached to the body 101. In some embodiments, accessory cradle cap 137 is integrally formed with body 101. Accessory cradle cap 137 comprises at least one sidewall that, when coupled with body 101, defines a cavity configured to accommodate at least a portion of the accessory attachment 113. In some embodiments, the cavity defined by the accessory cradle cap 137 and the recessed region of body 101 defining accessory attachment cradle 111 is configured to receive a neck portion of accessory attachment 113. In some embodiments, accessory cradle cap 137 comprises one or more drain holes 139 at a bottom portion thereof.

Figure 2:
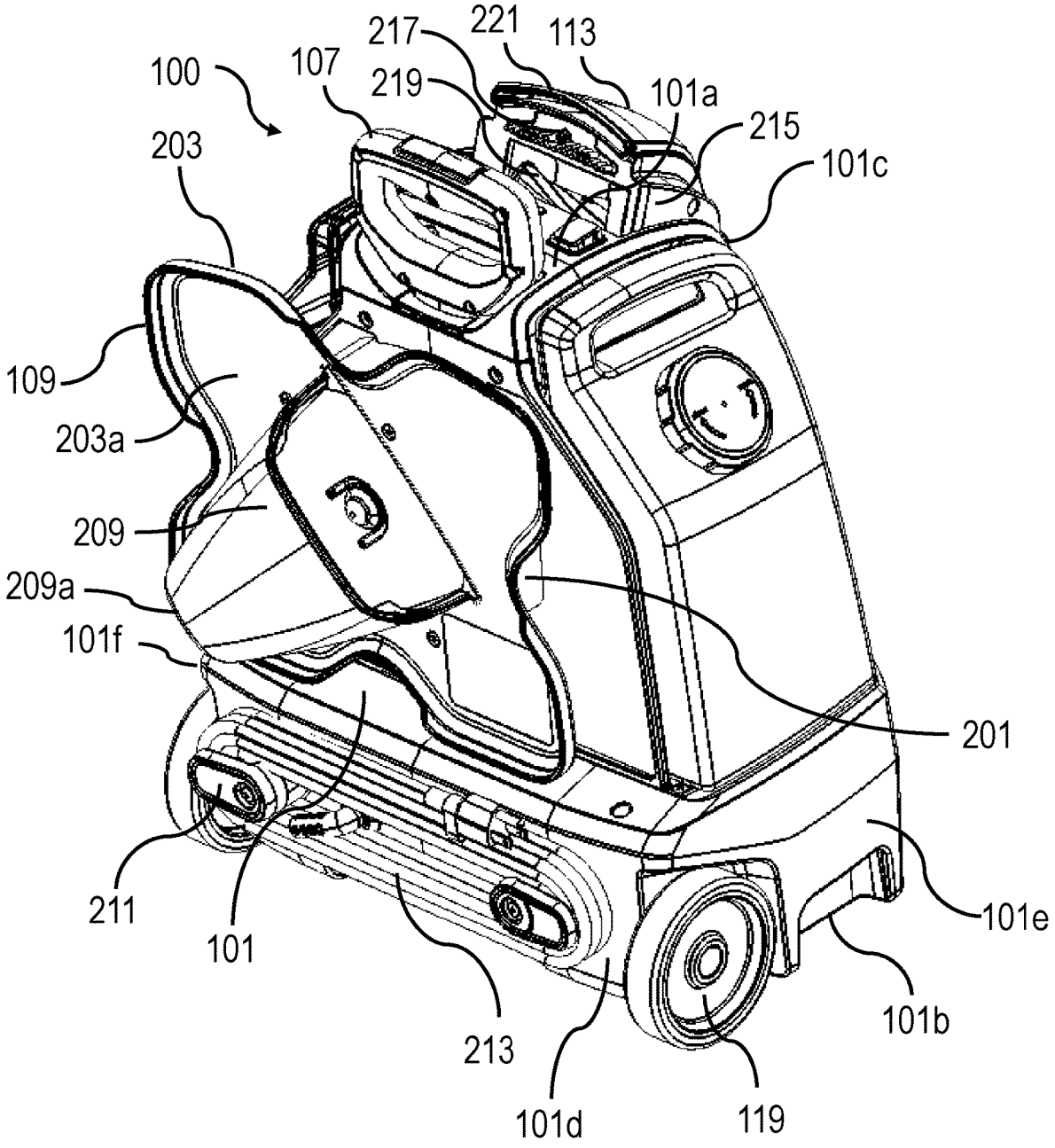
FIG. 2 is a rear-side perspective view of an apparatus, in accordance with some embodiments.

FIG. 2 is a rear-side perspective view of apparatus 100, in accordance with some embodiments. In FIG. 2, the accessory connection package 115 (FIG. 1) and the accessory handgrip 117 (FIG. 1) are removed. Hose rack 109 comprises a base 201 extending from a surface of back side 101*d* of the body 101, and a panel 203 on an end of the base 201 that is opposite to body 101. Panel 203 is configured to hold an accessory connection package such as accessory connection package 115 or a hose such as hose 131 in a space between the panel 203 and the body 101 if the hose is wrapped around the base 201. In some embodiments, panel 203 is x-shaped. The x-shaped panel improves a user's ability to wrap the accessory connection package or hose around base 201 without tangling. Additionally, the x-shaped panel has a reduced weight compared to a square, circular or rectangular-shaped panel, for example. In some embodiments, panel 203 is circular, triangular, square, rectangular, pentagonal, hexagonal, octagonal, elliptical, or some other suitable shape. In some embodiments, hose rack 109 is replaced by at least two hooks around which the accessory connection package or hose is capable of being wrapped.

A holster 209 is on a back side surface of the panel 203 opposite to a surface of the panel 203 facing the body 101. Holster 209 comprises at least one sidewall that defines a cavity configured to accommodate an accessory handgrip such as accessory handgrip 117 within the cavity. In some embodiments, holster 209 is releasably coupled with panel 203. In some embodiments, holster 209 is coupled with panel 203 by way of a push-pin or other suitable fastener to facilitate coupling and decoupling of the holster 209 to or from the panel 203. In some embodiments, holster 209 is integrally formed with panel 203. Holster 209 is configured to releasably hold the accessory handgrip in place. In some embodiments, the holster 209 is configured to hold an accessory handgrip such that a fluid output of the accessory handgrip faces a bottom side 209*a* of the holster 209. In some embodiments, the bottom side 209*a* of the holster 209 has one or more drain holes. If, for example, some fluid expelled from apparatus 100 by way of accessory handgrip 117, or some liquid or fluid drawn into hose 131, for example, by way of accessory handgrip 117 remains in the accessory handgrip 117 while the accessory handgrip 117 is accommodated in holster 209, the drain holes allow at least some of the remaining fluid or liquid to vacate the holster 209.

In some embodiments, body 101 has one or more hooks 211 configured to accommodate a power cord 213 configured to supply power to the apparatus 100. In some embodiments, at least one of the one or more hooks 211 is rotatably attached to a sidewall of body 101 to cause power cord 213, if wrapped around the hooks 211, to fall toward the ground based on a position of the hooks 211.

Handle 107 is positioned between the front side 101*c* of body 101 and the back side 101*d* of body 101. Handle 107 is positioned in a location on body 101 that is located nearer to the back side 101*d* of body 101 than to the front side 101*c* of body 101. In some embodiments, the positioning of the handle 107 improves a user's ability to carry the apparatus 100 in a balanced manner, as well as a user's ability to maneuver the apparatus 100 by pushing or pulling the apparatus 100, because the handle 107 is substantially aligned with a center of gravity of the apparatus 100 with or without the accessory attachment 113, the accessory connection package 115, or the accessory handgrip 117. In some embodiments, the positioning of the handle 107 improves a user's ability to carry the apparatus 100 in a secure manner, as well as a user's ability to maneuver the apparatus 100 by pushing or pulling the apparatus 100, because the handle 107 is positioned with respect to the hose rack 109 in a location that avoids interference with an accessory connection package or hose that is wrapped around the base 201 of hose rack 109.

Accessory attachment 113 is an upholstery cleaning head. Accessory attachment 113 comprises an accessory body 215, a fluid outlet 217, an agitator 219 and a nozzle 221. In use, the accessory attachment 113 is configured to expel fluid onto a surface opposite to accessory body 215. Agitator 219 is configured to move with respect to the surface opposite accessory body 215. Nozzle 221 is configured to contact or at least be opposing the surface opposite accessory body 215 such that one of more of air, fluid or debris is drawn from the surface opposite accessory body 215 into nozzle 221 based on a suction force provided by the vacuum motor housed within body 101. The suction force provided by the vacuum motor causes the air, fluid and/or debris to be drawn through the nozzle 221 into accessory handgrip 117 with which the accessory attachment 113 is attached, through hose 131 of accessory connection package 115 and into recovery tank 105.

Agitator 219 comprises one or more of a brush, a spin brush, a rotary brush, a blade, or some other suitable structure. An agitator motor that is communicatively coupled with agitator 219 and with an accessory electrical contact configured to be coupled with accessory handgrip 117 is housed within accessory body 215. The agitator motor is configured to cause the agitator 219 to move based on electricity received by way of an electrical contact of accessory handgrip 117. In some embodiments, the agitator motor is configured to cause the agitator 219 to move in a direction toward nozzle 221. In some embodiments, the agitator motor is configured to cause the agitator to move in a direction away from nozzle 221. In some embodiments, the agitator motor is configured to cause the agitator 219 to move in a direction toward nozzle 221 or away from nozzle 221 based on a direction of movement of the accessory body 215. The agitator motor is configured to cause the agitator 219 to move based on one or more of an instruction received from a controller with which the agitator motor is communicatively coupled, or power supplied to the agitator motor by way of the accessory handgrip 117.

Figure 3:
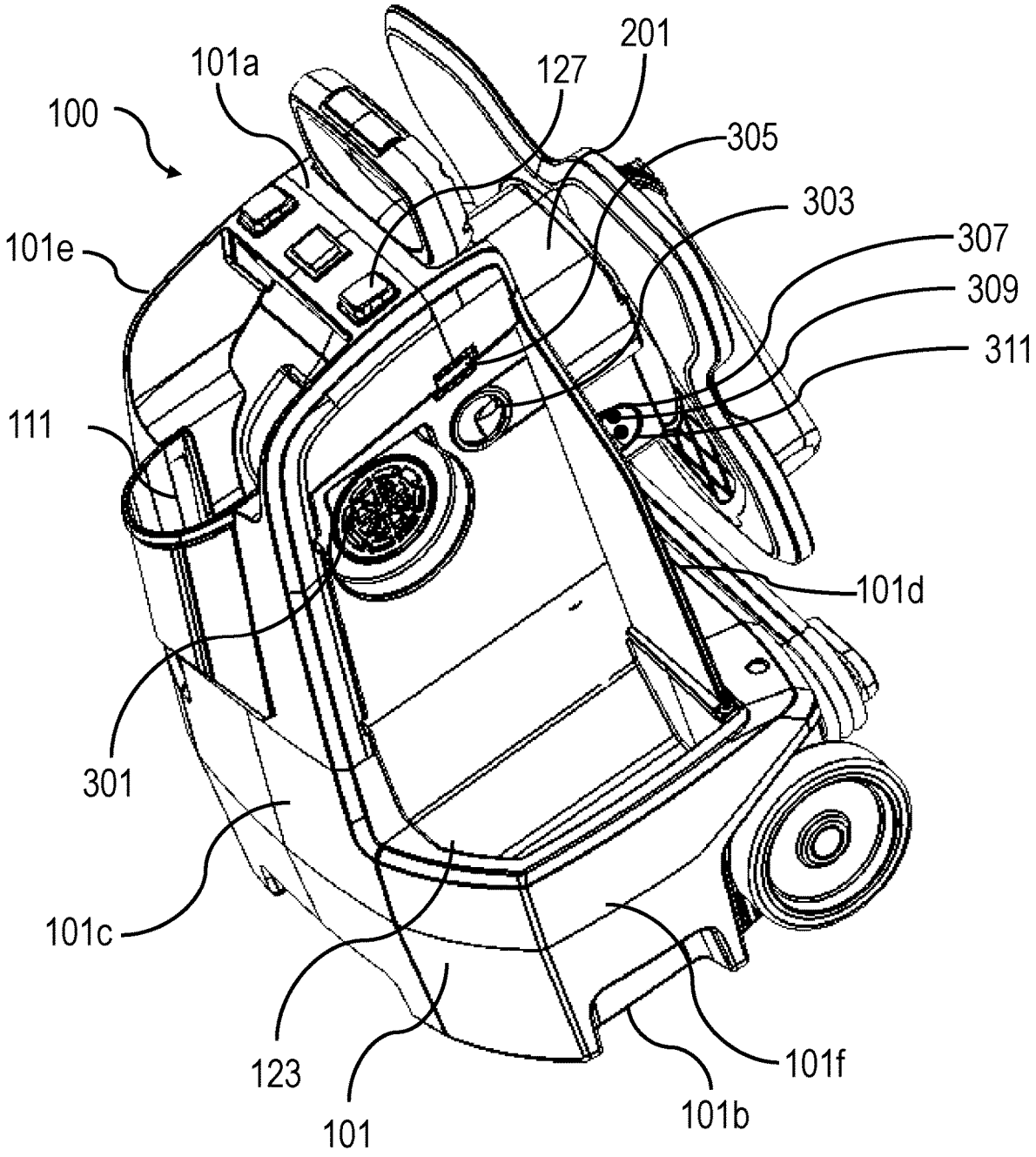
FIG. 3 is an upper right-side perspective view of an apparatus, in accordance with some embodiments.

FIG. 3 is an upper right-side perspective view of apparatus 100, in accordance with some embodiments. In FIG. 3, the cleaning fluid tank 103 (FIG. 1), the recovery tank 105 (FIG. 1), the accessory attachment 113 (FIG. 1), the accessory connection package 115 (FIG. 1) and the accessory handgrip 117 (FIG. 1) are removed.

The body 101 has a first air passage 301 configured to be communicatively coupled with the recovery tank 105, and a second air passage 303 configured to be communicatively coupled with the recovery tank 105. The first air passage 301 is communicatively coupled with an inlet of a vacuum motor accommodated within body 101. In some embodiments, first air passage 301 is defined by a sidewall of body 101 that includes a recessed portion configured to mate with a corresponding portion of recovery tank 105. The second air passage 303 is defined by a sidewall of body 101 and is communicatively coupled with a hose port configured to be communicatively coupled with an accessory connection package such as accessory connection package 115 or a hose such as hose 131.

The tank seat 123 is a concave region of body 101 configured to receive the recovery tank 105. The first air passage 301 and the second air passage 303 are on a sidewall of the body 101 configured to face the recovery tank 105 if the recovery tank 105 is in tank seat 123. Locking mechanism 127 is communicatively coupled with a lock member 305 configured to interact with recovery tank 105 if recovery tank 105 is in the tank seat 123 and the first air passage 301 and the second air passage 303 are coupled with the recovery tank 105.

An accessory receptacle 307 is on base 201. Accessory receptacle comprises an electrical contact 309 and a fluid coupling 311. Accessory receptacle 307, electrical contact 309 and fluid coupling 311 are configured to facilitate the provision of one or more of power or cleaning fluid to an accessory attachment such as accessory attachment 113 or accessory handgrip 117, for example.

In some embodiments, accessory receptacle 307 is configured to receive an accessory connector having a structure configured to fit within the accessory receptacle 307, a corresponding electrical contact for making an electrical connection between an accessory attachment or accessory handgrip and the electrical contact 309, and a corresponding fluid coupling configured to engage the fluid coupling 311 to facilitate fluid flow from the fluid coupling 311 to the accessory attachment or accessory handgrip. In some embodiments, electrical contact 309 is communicatively coupled with a controller of apparatus 100. Accessory electrical contact 223 comprises a metal, a semiconductor, a non-metallic conductor, or some other suitable electrically conductive material.

Fluid coupling 311 is communicatively coupled with a body fluid coupling of body 101 through which fluid is received from the cleaning fluid tank 103 by way of a fluid flow path extending from the body fluid coupling to the fluid coupling 311.

Accessory receptacle 307 is on a recovery tank 105 side of the base 201. Accessory receptacle 307 is on a cleaning fluid tank 103 side of the base 201. In some embodiments, accessory receptacle 307 is on a front side 101*c* of body 101. In some embodiments, accessory receptacle 307 is on a back side 101*d* of body 101. In some embodiments, accessory receptacle 307 is in some other suitable position on body 101, or in some other suitable position on base 201.

Figure 4:
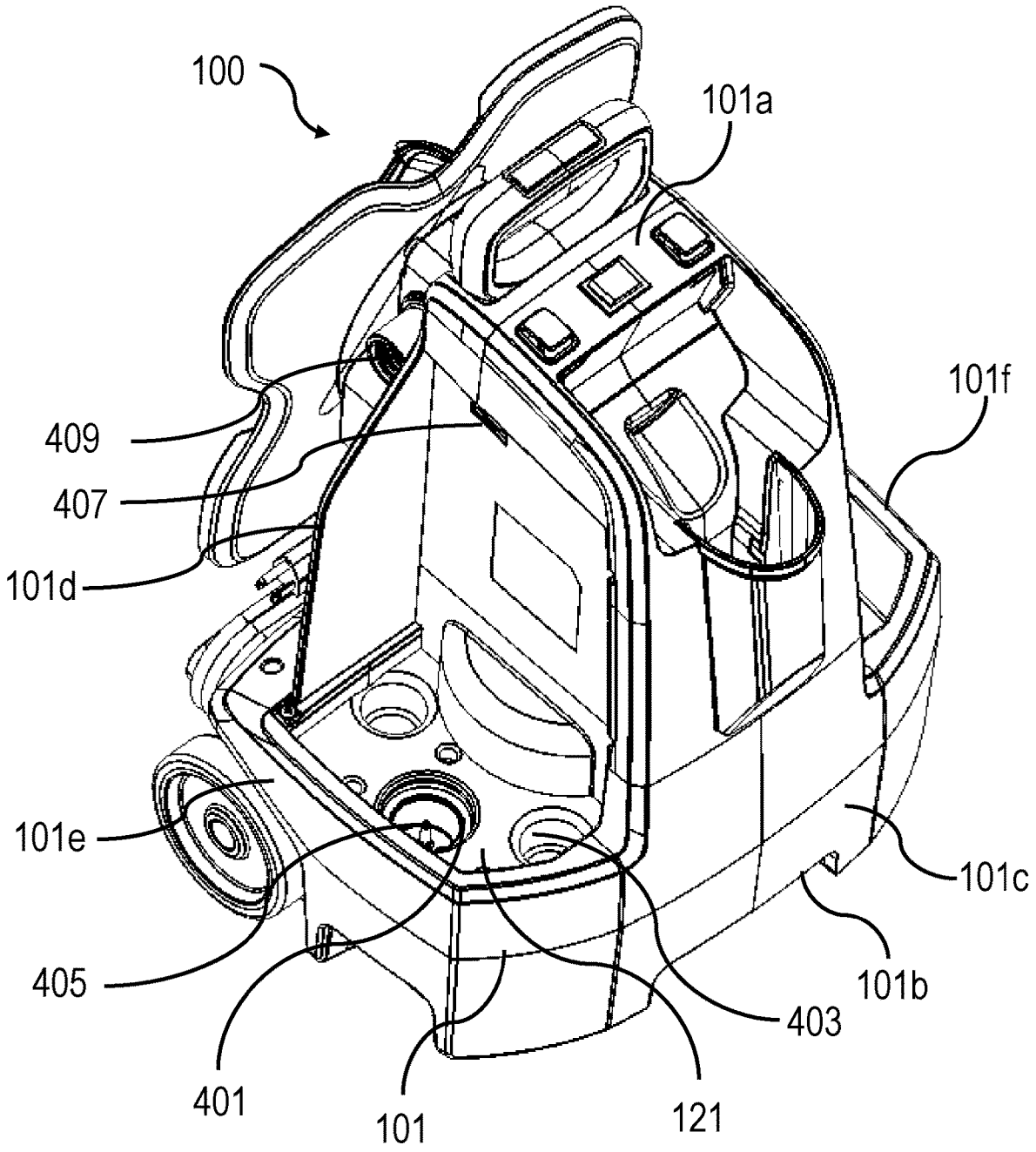
FIG. 4 is an upper left-side perspective view of an apparatus, in accordance with some embodiments.

FIG. 4 is an upper left-side perspective view of apparatus 100, in accordance with some embodiments. In FIG. 4, the cleaning fluid tank 103 (FIG. 1), the recovery tank 105 (FIG. 1), the accessory attachment 113 (FIG. 1), the hose 131 (FIG. 1) and the accessory handgrip 117 (FIG. 1) are removed.

The tank seat 121 is a concave region of body 101 configured to receive the cleaning fluid tank 103. Tank seat 121 includes a body fluid coupling 401 and at least one cleaning fluid tank alignment guide 403. The at least one cleaning fluid tank alignment guide 403 is configured to mate with a correspondingly-shaped portion of cleaning fluid tank 103. The body fluid coupling 401 is on a bottom of tank seat 121. Body fluid coupling 401 comprises a cup-shaped receptacle within which a fluid coupling of cleaning fluid tank 103 is configured to be placed upon assembly.

The cleaning fluid tank alignment guide 403 is a concave structure within tank seat 121. In some embodiments, the body fluid coupling 401 is a convex structure within tank seat 121. In some embodiments, the cleaning fluid tank alignment guide 403 is a convex structure within tank seat 121. In some embodiments, the tank seat 121 is free from including a cleaning fluid tank alignment guide 403.

In some embodiments, body fluid coupling 401 comprises a pin 405 or other suitable structure configured to mate with a portion of cleaning fluid tank 103 to cause a cleaning fluid contained within the cleaning fluid tank 103 to flow out of the cleaning fluid tank 103.

A third air passage 409 is on a cleaning fluid tank 103 side of base 201. The third air passage 409 is communicatively coupled with the second air passage 303 (FIG. 3). In some embodiments, third air passage 409 is on a front side 101*c* of body 101. In some embodiments, third air passage 409 is on a back side 101*d* of body 101. In some embodiments, third air passage 409 is in some other suitable position on body 101 or on base 201. In some embodiments, third air passage 409 is on a side of the base 201 that is opposite to that of the accessory receptacle 307.

Third air passage 409 is configured to be communicatively coupled with a hose such as hose 131 of accessory connection package 115. In some embodiments, the position of the third air passage 409 with respect to the accessory receptacle 307 increases a user's ability to connect the hose with the third air passage 409 and to connect a power supply line and a fluid supply line such as power supply line 135 and fluid supply line 133 of accessory attachment package 115 with the accessory receptacle without interference from the other of the hose or the power supply line and/or the fluid supply line.

Figure 5:
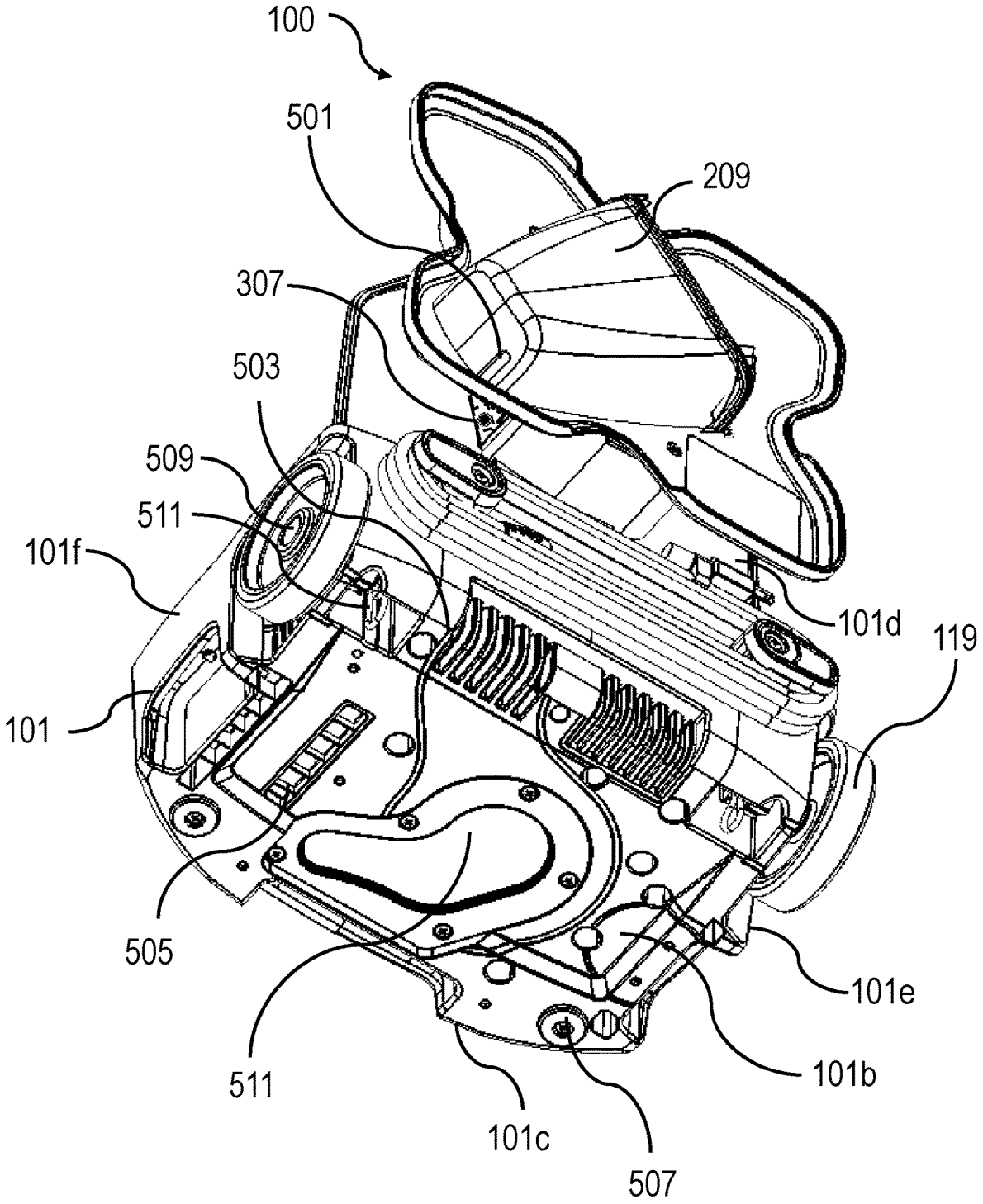
FIG. 5 is a lower back side perspective view of an apparatus, in accordance with some embodiments.

FIG. 5 is a lower back side perspective view of apparatus 100, in accordance with some embodiments. In FIG. 5, the cleaning fluid tank 103 (FIG. 1), the recovery tank 105 (FIG. 1), the accessory attachment 113 (FIG. 1), the hose 131 (FIG. 1) and the accessory handgrip 117 (FIG. 1) are removed. Holster 209 includes drain hole 501 at a bottom of holster 209.

The bottom side 101*b* of body 101 has a fourth air passage 503 communicatively coupled with an outlet of the vacuum motor housed within body 101. The fourth air passage 503 is configured to cause air exhausted by the vacuum motor to blow onto a surface beneath the body 101. In some embodiments, the fourth air passage 503 is defined by a plurality of slots in the bottom side 101*b* of body 101 and dividers that are configured to cause air exhausted by the vacuum motor to flow out of the fourth air passage 503 in a predetermined direction toward the surface beneath the body 101 or to effect a turbulent flow of the air from the fourth air passage 503 to increase a drying effect on the surface beneath the body 101. In some embodiments, the body 101 comprises a cavity vent 505 communicatively coupled with the cavity inside the body 101. The cavity vent 505 is configured to dissipate heat from the cavity inside the body 101 toward a surface beneath the body 101.

Contact pads 507 are include on the bottom side 101*b* of body 101. The contact pads 507 are configured to support at least a portion of the bottom side 101*b* of body 101 above a surface in contact with at least one of wheels 119. Contact pads 507 comprise a stationary structure that projects outwardly from the bottom side 101*b* of body 101. In some embodiments, contact pads 507 are replaced by one or more wheels similar to wheels 119. In some embodiments, contact pads 507 are replaced by one or more wheels that are different from wheels 119, roller balls, or other suitable structure.

Wheels 119 are rotatably coupled with the body 101. Wheels 119 are configured to support at least a portion of the bottom side 101*b* of body 101 above a surface in contact with at least one of wheels 119. Each of the wheels 119 is independently coupled with body 101 so that each wheel 119 is free to rotate about a corresponding axis of rotation. In some embodiments, wheels 119 are independently coupled with body 101 by a corresponding axle 509 and pin fastener 511. In some embodiments, wheels 119 are each attached to a single axle that extends from the left side 101*e* of body 101 to the right side 101*f* of body 101. In some embodiments, if attached to a single axle, each of wheels 119 is configured to rotate independently around the single axle.

Bottom side 101*b* of body 101 includes at least one access panel 513 configured to facilitate access to the cavity within body 101. In some embodiments, access panel 513 defines a portion of a channel within body 101 that coupled first air passage 301 with an inlet of the vacuum motor within body 101. Access panel 513 is configured to provide a user the ability to reach the motor, the channel within body 101, or one or more other components housed within the body 101 for servicing the apparatus 100.

Figure 6:
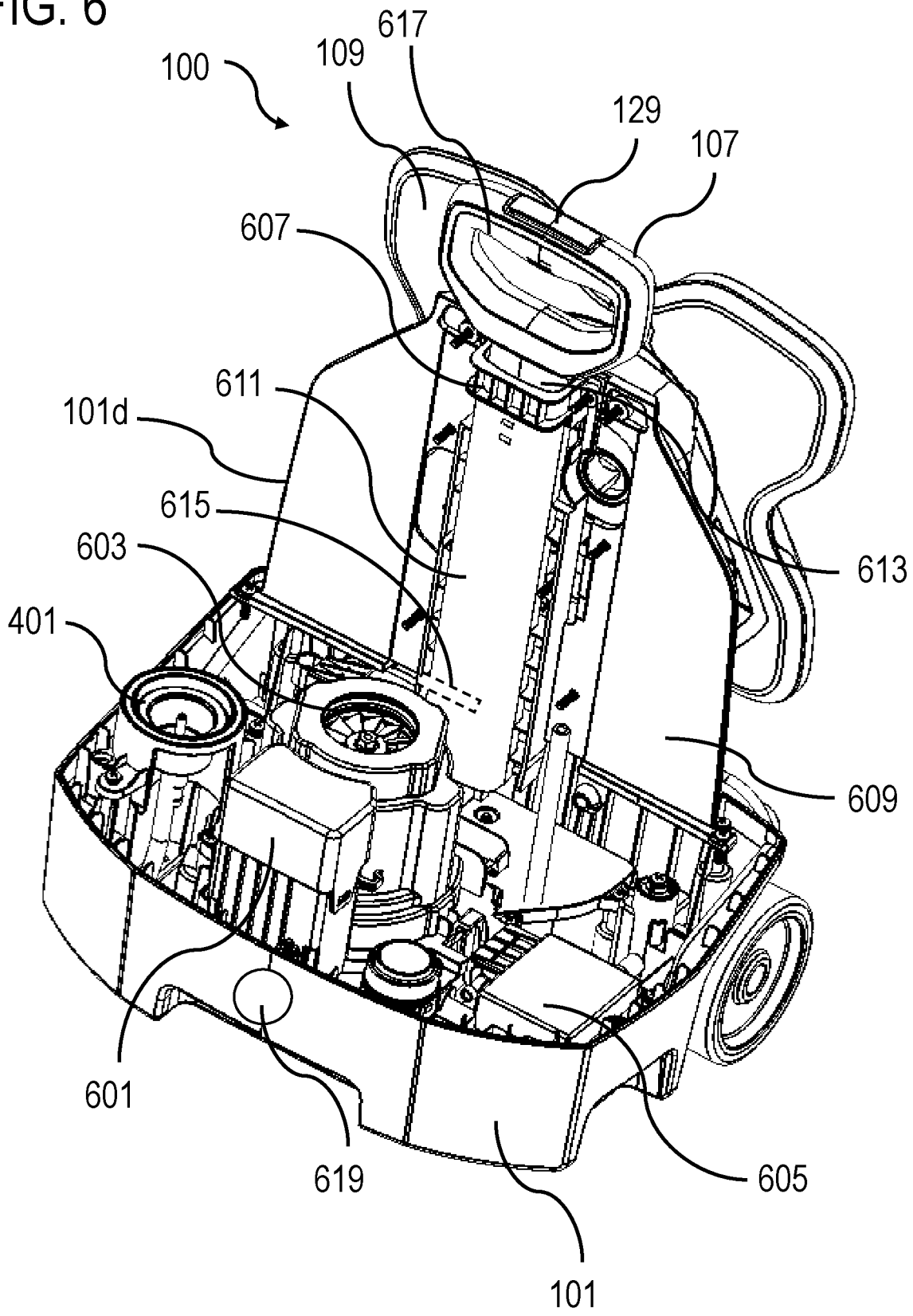
FIG. 6 is an upper right-side perspective view of an apparatus, in accordance with some embodiments.

FIG. 6 is an upper right-side perspective view of apparatus 100, in accordance with some embodiments. In FIG. 6, the cleaning fluid tank 103, the recovery tank 105, the panels of body 101 that define the front side 101*b*, left side 101*e*, right side 101*f*, and tank seats 121 and 123 of body 101 have been removed.

A controller 601 is housed inside the body 101. In some embodiments, the controller 601 is outside the body 101. In some embodiments, one or more of a vacuum motor 603 having an inlet and an outlet, or a fluid pump 605 is one or more of on or housed within the cavity of body 101.

A handle support bracket 607 is attached to a panel 609 on the back side 101*d* of body 101. Handle support bracket 607 is configured to secure a sleeve 611 through which a neck 613 of handle 107 slides as the handle 107 is moved between the collapsed position and the extended position. Sleeve 611 is configured to interact with one or more locking member 615 to hold the handle 107 in the collapsed position. Release mechanism 129 is communicatively coupled with the one or more locking members 615 to release the handle 107 from a locked state to allow the handle 107 to be moved from the collapsed position to the extended position. For example, if the release mechanism 129 is actuated, the one or more locking members 615 are caused to move inward into the neck 613 to allow the neck 613 to slide through the sleeve 611 so that the handle 107 can be moved from the collapsed position to the extended position. In some embodiments, the locking members 615 comprise a detent lock, pin, or other suitable structure configured to project outwardly through a slot in a sidewall of neck 613 to facilitate interaction with sleeve 611 for locking the handle 107 in the collapsed position.

Handle 107 includes a grip portion 617. In some embodiments, grip portion 617 is substantially ring-shaped to facilitate ambidextrous operation, lifting and/or pushing/pulling of the apparatus 100. Grip portion 617 is substantially centered with respect to the neck 613 of the handle 107. In some embodiments, grip portion 617 is elliptical, circular, square, rectangular, pentagonal, hexagonal, octagonal, or some other suitable shape.

Figure 18:
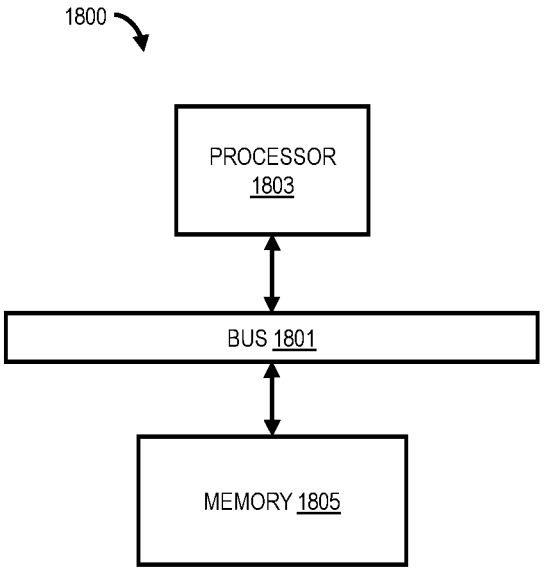
FIG. 18 is a functional block diagram of a computer or processor-based system upon which or by which an embodiment is implemented.

Controller 601 comprises a chipset having a processor and a memory (e.g., processor-based system 1800, FIG. 18). Controller 601 is communicatively coupled with one or more of the vacuum motor 603 or the fluid pump 605. In some embodiments, the memory included in the controller 601 has computer executable instructions stored thereon that, when executed by the processor of controller 601, cause the vacuum motor 603 to turn on or off. In a default operative state, the vacuum motor 603 is configured to draw air into the inlet of the vacuum motor 603 and exhaust air from the outlet of the vacuum motor 603. In some embodiments, the controller 601 is configured to cause the vacuum motor 603 to run in reverse such that the vacuum motor 603 draws air into the outlet of the vacuum motor 603 and exhausts air from the inlet of the vacuum motor 603.

In some embodiments, body 101 comprises a headlight 619 communicatively coupled with the controller 601. If body 101 includes headlight 619, controller 601 is configured to cause the headlight 619 to be on or off based on an actuation of a system power switch, a light control switch, a fluid release, or other suitable switch, or one or more of the controller 601 or vacuum motor 603, or other suitable component of body 101 being turned on.

Figure 7:
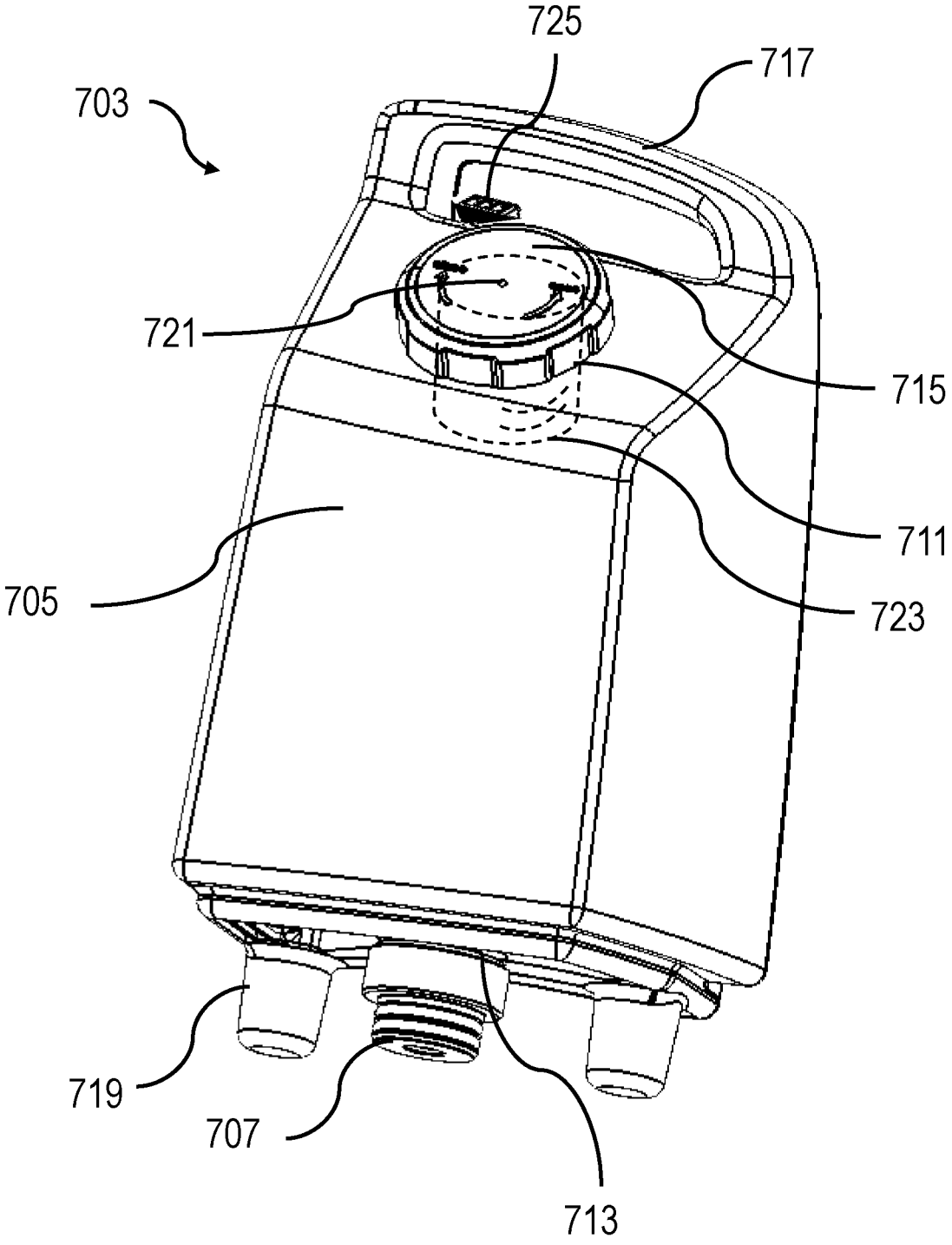
FIG. 7 is a perspective view of a cleaning fluid tank, in accordance with some embodiments.

FIG. 7 is a perspective view of a cleaning fluid tank 703, in accordance with some embodiments. Cleaning fluid tank 703 is usable as cleaning fluid tank 103 (FIG. 1) in apparatus 100 (FIG. 1). Cleaning fluid tank 703 comprises a vessel 705 configured to accommodate a cleaning fluid, a tank fluid coupling 707, a vessel inlet 711, a vessel outlet 713, a cap 715, a handle 717 and one or more tank alignment supports 719.

Vessel 705 comprises one or more sidewalls defining a cavity therein. Vessel 705 is configured to hold a predetermined volume of cleaning fluid comprising one or more of a liquid, a solid, water, a detergent, a gas, or some combination thereof. The one or more sidewalls of vessel 705 comprise one or more of a polymer, a metal, glass, a composite material, or some other suitable material capable of holding the predetermined volume of cleaning fluid. In some embodiments, at least one sidewall of the one or more sidewalls of vessel 705 comprises a transparent material. In some embodiments, at least one sidewall of the one or more sidewalls of vessel 705 comprises an opaque material. In some embodiments, at least one sidewall of the one or more sidewalls of vessel 705 comprises a translucent material capable of hiding waste material within the vessel 705 from plain view while allowing some light to pass through the vessel 705 such that a volume of cleaning fluid accommodated therein is viewable from outside the vessel 705.

The tank fluid coupling 707 is configured to be communicatively coupled with a body fluid coupling on body 101 (FIG. 1), such as body fluid coupling 401 (FIG. 4) on body 101, or some other suitable connector. The tank fluid coupling 707 is configured to mate with the tank fluid coupling on body 101 to facilitate flow of cleaning fluid from the cleaning fluid tank 703 through vessel outlet 713 and into the body fluid coupling of body 101. In some embodiments, tank fluid coupling 707 is configured to be inserted into the body fluid coupling of body 101. Tank fluid coupling 707 is on a lower side of vessel 705. In some embodiments, tank fluid coupling 707 extends away from the lower side of vessel 705. The cleaning fluid tank 703 comprises one or more tank alignment supports 719 on the lower side of vessel 705. In some embodiments, the one or more tank alignment supports 719 are configured to extend to a distance away from a reference position within the vessel 705 that is substantially equal to a distance that the tank fluid coupling 707 extends in a direction away from the reference position within the vessel 705. In some embodiments, the one or more tank alignment supports 719 are configured to prevent the cleaning fluid tank 703 from tipping over on account of an amount that the tank fluid coupling 707 extends away from the lower side of the vessel 705. In some embodiments, the one or more tank alignment supports 719 are configured to mate with a cleaning fluid tank alignment guide on body 101 such as cleaning fluid tank alignment guide 403 (FIG. 4) of body 101.

Cap 715 is configured to close the vessel inlet 711. The cap 715 has an air hole 721. In some embodiments, the vessel 705 has the air hole 721 in an upper portion of the vessel 705. In some embodiments, the cleaning fluid tank 703 is free from having a straw or tube extending from a lower portion of the vessel 705 to the upper portion of the vessel 705.

In some embodiments, cap 715 comprises a measuring cup portion 723 configured to fit within the vessel inlet 711 and inside the vessel 705 if the cap 715 closes the vessel inlet 711. The measuring cup portion 723 is separated from an inner surface of the cap 715 by a gap configured to allow air to flow into or out of the vessel 705, around the measuring cup portion 723, and through air hole 721. The gap between the measuring cup portion 723 and the inner surface of the cap 715 makes it possible for the measuring cup portion 723 to hold a volume of a fluid without the fluid leaking out through the air hole 721.

The tank fluid coupling 707 is configured to prevent cleaning fluid from flowing out of the vessel 705 unless the tank fluid coupling 707 is coupled with the body fluid coupling of body 101. For example, if the tank fluid coupling 707 is coupled with body fluid coupling 401 of body 101, the pin 405 (FIG. 4) is inserted into tank fluid coupling 707. The tank fluid coupling 707 comprises a valve that is configured to open upon insertion of the pin 405. In some embodiments, the tank fluid coupling 707 comprises a different suitable type of valve or seal that is capable of being opened upon connection with the body fluid coupling on body 101.

In some embodiments, air hole 721 is pin-sized in diameter. The pin-size diameter is small enough to prevent fluid to flow out of the vessel 705 unless the tank fluid coupling 707 is opened.

In some embodiments, cleaning fluid tank 703 comprises cleaning tank locking member 725 configured to be coupled with a corresponding locking mechanism of body 101 such as locking mechanism 407 (FIG. 4) such that cleaning fluid tank 703 is removably secured in tank seat 121.

Figure 8:
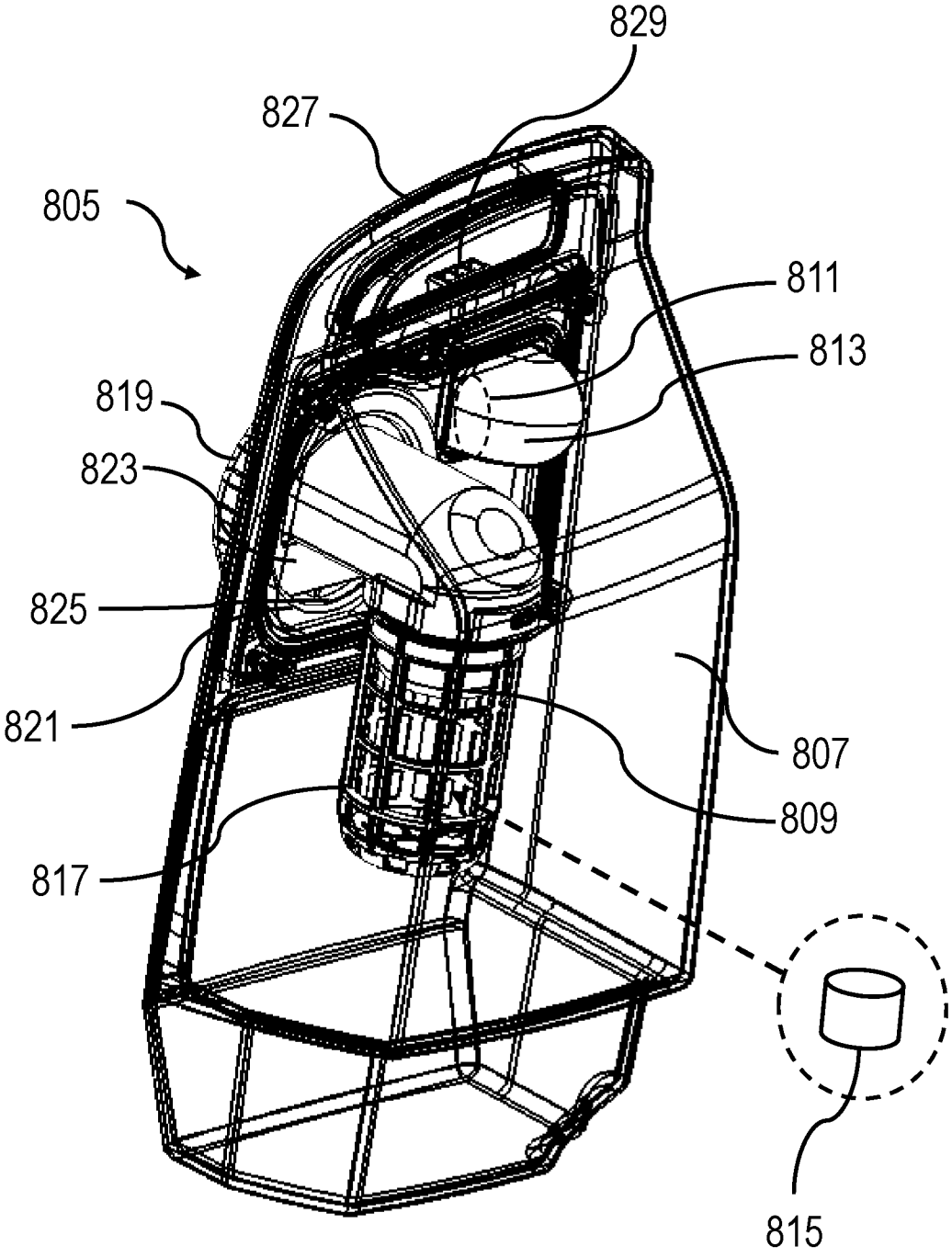
FIG. 8 is a perspective view of a recovery tank, in accordance with some embodiments.

FIG. 8 is a perspective view of a recovery tank 805, in accordance with some embodiments. Recovery tank 805 is usable as recovery tank 105 (FIG. 1) in apparatus 100 (FIG. 1). Recovery tank 805 comprises a recovery tank vessel 807 configured to accommodate a composition comprising one or more of a liquid, a solid, a gas, or a portion of the cleaning fluid output from the cleaning fluid tank 103 (FIG. 1). Recovery tank 805 includes a first tank air passage 809 configured to be communicatively coupled with an air passage on body 101 such as first air passage 301 (FIG. 3) of body 101, a second recovery tank air passage 811 configured to be communicatively coupled with another air passage on body 101 such as second air passage 303 of body 101.

Recovery tank vessel 807 comprises one or more sidewalls defining a cavity therein. Recovery tank vessel 807 is configured to hold a predetermined volume of the composition comprising one or more of the liquid, solid, gas, or portion of the cleaning fluid. The one or more sidewalls of recovery tank vessel 807 comprise one or more of a polymer, a metal, glass, a composite material, or some other suitable material capable of holding the predetermined volume of composition comprising one or more of the liquid, solid, gas, or portion of the cleaning fluid. In some embodiments, at least one sidewall of the one or more sidewalls of recovery tank vessel 807 comprises a transparent material. In some embodiments, at least one sidewall of the one or more sidewalls of recovery tank vessel 807 comprises an opaque material. In some embodiments, at least one sidewall of the one or more sidewalls of recovery tank vessel 807 comprises a translucent material capable of hiding waste material within the recovery tank vessel 807 from plain view while allowing some light to pass through the recovery tank vessel 807 such that a volume of the composition accommodated therein is viewable from outside the recovery tank vessel 807.

In some embodiments, a diverter 813 is internal to recovery tank vessel 807. Diverter 813 is configured to change a direction of flow of the liquid, solid, gas or portion of the fluid drawn into the recovery tank vessel 807 by way of the second recovery tank air passage 811. In some embodiments, diverter 813 is curved so that the liquid, solid, gas or portion of the fluid drawn into the recovery tank vessel 807 is directed away from a center portion of the interior of recovery tank vessel 807. In some embodiments, diverter 813 is some other suitable shape configured to direct the liquid, solid, gas or portion of the fluid drawn into the recovery tank vessel 807 away from the center portion of the interior of recovery tank vessel 807. In some embodiments, diverter 813 configured to prevent or reduce an amount of foam generated inside the recovery tank vessel 807 as the liquid, solid, gas or portion of the fluid is drawn into the recovery tank vessel 807 by directing the flow away from the center portion of the interior of recovery tank vessel 807. In some embodiments, diverter 813 configured to prevent or reduce an amount of foam generated inside the recovery tank vessel 807 as the liquid, solid, gas or portion of the fluid is drawn into the recovery tank vessel 807 by causing a turbulent flow that breaks-down foam generated inside the recovery tank vessel 807.

Diverter 813 comprises a rigid structure. In some embodiments, diverter 813 is removably attached to an interior of the recovery tank vessel 807. In some embodiments, diverter 813 is removably attached to an exterior of the recovery tank vessel 807. In some embodiments, diverter 813 is a flexible or movable structure configured to be manipulated into one or more positions to adjust a direction of flow or a degree of turbulence caused. In some embodiments, diverter 813 is fixed to an interior of the recovery tank vessel 807. In some embodiments, diverter 813 is fixed to an exterior of the recovery tank vessel 807.

In some embodiments, recovery tank 805 includes a stopper 815 inside the recovery tank vessel 807. The stopper 815 is configured to at least substantially seal first tank air passage 809 based, at least in part, on a volume of the liquid, solid, gas or portion of the fluid composition accommodated by the recovery tank vessel 807. In some embodiments, the stopper 815 comprises a flotation device that is configured to rise toward first tank air passage 809 based, at least in part, on a volume of the liquid, solid, gas or portion of the fluid composition accommodated by the recovery tank vessel 807. In some embodiments, stopper 815 is spherical and is configured to substantially seal first tank air passage 809 based on one or more of a depth of the composition accommodated by recovery tank vessel 807 or a suction of air from first tank air passage 809 by a vacuum motor, such as vacuum motor 603 (FIG. 6).

In some embodiments, stopper 815 comprises at least one plug configured to substantially seal the first tank air passage 809 based on one or more of a depth of the composition accommodated by recovery tank vessel 807 or a suction of air by way of first tank air passage 809 by the vacuum motor of body 101. In some embodiments, the controller of body 101, such as controller 601 (FIG. 6), is configured to determine the recovery tank is full based on a determination that the stopper 815 is in position to substantially seal the first tank air passage 809. In some embodiments, the controller of body 101 is configured to determine the stopper 815 is in position to substantially seal the first tank air passage 809 based on a loss of suction by or a load on vacuum motor 603. In some embodiments, the controller of body 101 is configured to cause the vacuum motor of body 101 to turn off or an alert to be output indicating that the recovery tank 805 is full.

In some embodiments, recovery tank 805 comprises a cage 817 configured to allow the stopper 815 to move freely between an inside of the cage 817 and the first tank air passage 809. In some embodiments, cage 817 is configured to be removably attached to an interior of recovery tank vessel 807 and accommodated within recovery tank vessel 807. In some embodiments, cage 817 is fixed to the interior of recovery tank vessel 807. In some embodiments, cage 817 is configured to be removably attached to an exterior of recovery tank vessel 807 and accommodated within recovery tank vessel 807. In some embodiments, cage 817 is fixed to an exterior of recovery tank vessel 807 and accommodated within recovery tank vessel 807.

In some embodiments, recovery tank 805 comprises a recovery tank cap 819 configured to at least partially close the drain opening 821 defined by one or more sidewalls of recovery tank 805. In some embodiments, cage 817 is configured to be removably attached to the recovery tank cap 819 and configured to be accommodated within recovery tank vessel 807 when the recovery tank cap 819 is attached to close the drain opening 821. In some embodiments, cage 817 is fixed to the recovery tank cap 819 and accommodated within recovery tank vessel 807 when the recovery tank cap 819 is attached to close the drain opening 821.

In some embodiments, a base member 823 is accommodated within a recess in the recovery tank vessel 807, or a panel attached thereto, that surrounds the drain opening 821. The recovery tank cap 819 is configured to be affixed to the recovery tank vessel 807 or the panel attached thereto to hold the cage 817 in the recess to cause the base member 823 to close the drain opening 821. In some embodiments, recovery tank cap 819 is a collar that has an opening configured to facilitate a communicative coupling between first tank air passage 809 and the first air passage 301 of body 101.

In some embodiments, the recovery tank cap 819 is a collar configured to be screwed onto a threaded projection extending away from the recovery tank vessel 807 and surrounding the drain opening 821. The base member 823 is a flange having an internal air passage that extends from the first tank air passage 809 to an exterior of the recovery tank vessel 807. The base member 823 extends into the recovery tank vessel 807 and the cage 817 is on an end thereof. The base member 823 and the cage 817 are configured to be removable from an inside of the recovery tank vessel 807 if the recovery tank cap 819 is removed from the threaded projection, and secured between the recovery tank cap 819 and the threaded projection if the base member 823 is between the recovery tank cap 819 and the threaded projection at a time the recovery tank cap 819 is screwed onto the threaded projection. The internal air passage of the base member 823 is exposed through the recovery tank cap 819 so that the first tank air passage 809 is capable of being communicatively coupled with the first air passage 301 of body 101 if the recovery tank 805 is in tank seat 123.

In some embodiments, recovery tank 805 comprises a handle 827. In some embodiments, handle 827 is integrally formed with recovery tank vessel 807. In some embodiments, handle 827 is attached to recovery tank vessel 807.

In some embodiments, recovery tank 805 comprises recovery tank locking member 829 configured to be coupled with a corresponding locking mechanism of body 101 such that recovery tank 805 is removably secured to body 101 in tank seat 123. In some embodiments, recovery tank cap 819 is configured to mate with a recessed region surrounding first air passage 301 of the recovery tank 805 is secured in tank seat 123.

Figure 9:
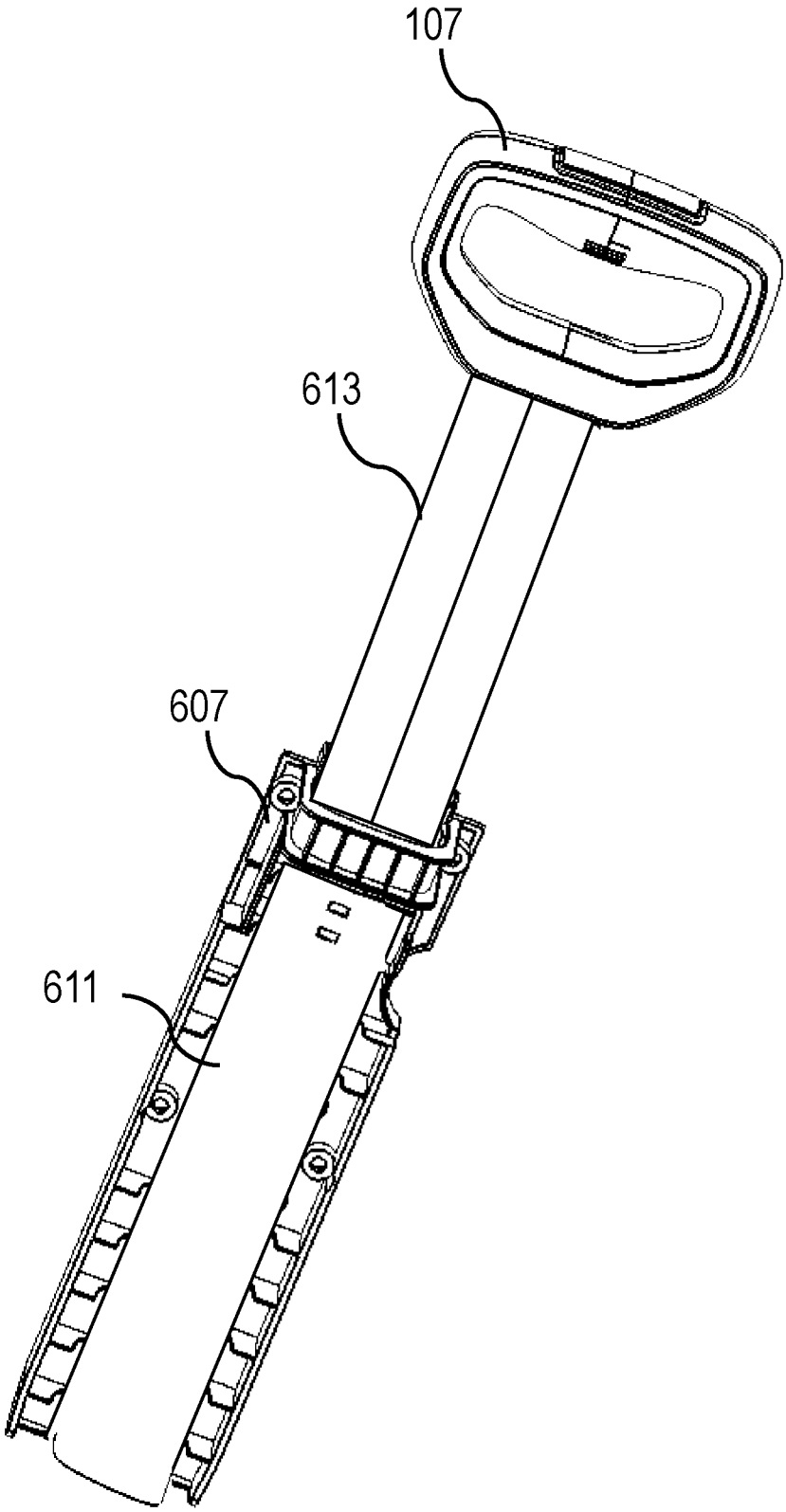
FIG. 9 is a perspective view of a handle in an extended position, in accordance with some embodiments.

FIG. 9 is a perspective view of handle 107 in an extended position, in accordance with some embodiments. The neck 613 of handle 107 has been pulled through sleeve 611. In some embodiments, a bottom end of neck 613 is communicatively coupled with release mechanism 129 such that the neck 613 is locked in the extended position if the bottom end of the neck 613 is pulled into an upper portion of sleeve 611 while moving the handle 107 from the collapsed position to the extended position.

The handle support bracket 607 is configured to be attached to the panel 609 (FIG. 6) on the back side 101*d* of body 101 (FIG. 6), and configured to secure sleeve 611 within body 101. Sleeve 611 is configured to receive the neck 613 of handle 107 if the release mechanism 129 is actuated and the handle 107 is pushed through the sleeve 611 for locking in the collapsed position.

Figure 10:
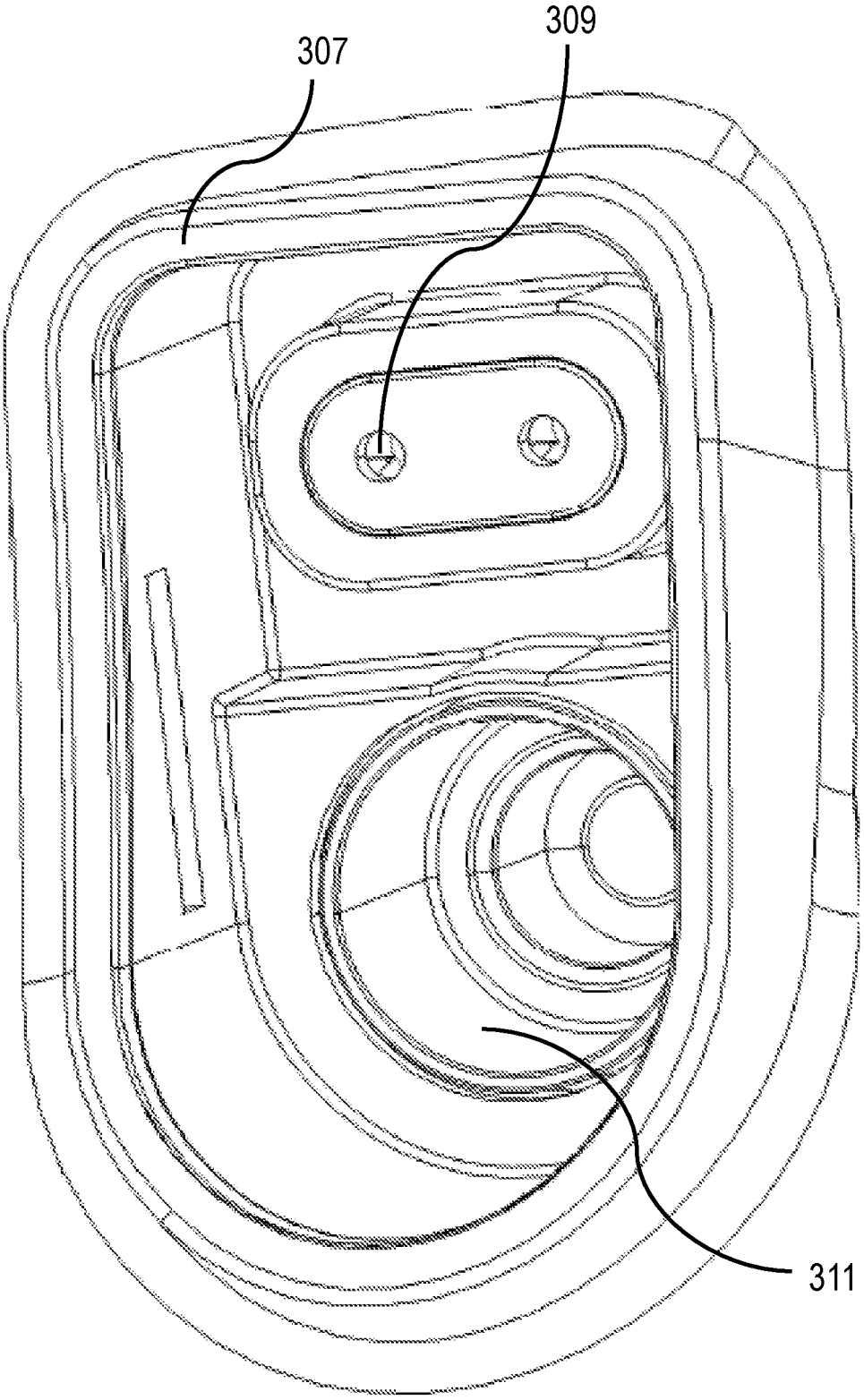
FIG. 10 is a perspective view of an accessory receptacle, in accordance with some embodiments.

FIG. 10 is a perspective view of an accessory receptacle 307, in accordance with some embodiments. Accessory receptacle 307 comprises electrical contact 309 and fluid coupling 311. Accessory receptacle 307 is configured to facilitate the provision of one or more of power or cleaning fluid to an accessory attachment such as accessory attachment 113 (FIG. 1) or an accessory handgrip such as accessory handgrip 117 (FIG. 1).

In some embodiments, accessory receptacle 307 is configured to receive an accessory connector having a structure configured to fit within the accessory receptacle 307, having a corresponding electrical contact for making an electrical connection between the accessory attachment or accessory handgrip and the electrical contact 309, and having a corresponding fluid coupling configured to engage the fluid coupling 311 to facilitate fluid flow from cleaning fluid tank 103 to an accessory attachment.

In some embodiments, the interior of the accessory receptacle 307 has a stepped surface such that the electrical contact 309 and the fluid coupling 311 are capable of concurrently making a secure connection with the corresponding electrical contact and the corresponding fluid coupling of the accessory connector for making an electrical connection and for facilitating fluid flow upon receiving the accessory in an installed position within accessory receptacle 307. In some embodiments, the fluid coupling 311 is configured to receive a nipple-type connector included on a corresponding fluid connector to fluidically couple the cleaning fluid tank 103 with the accessory connector.

Figure 11:
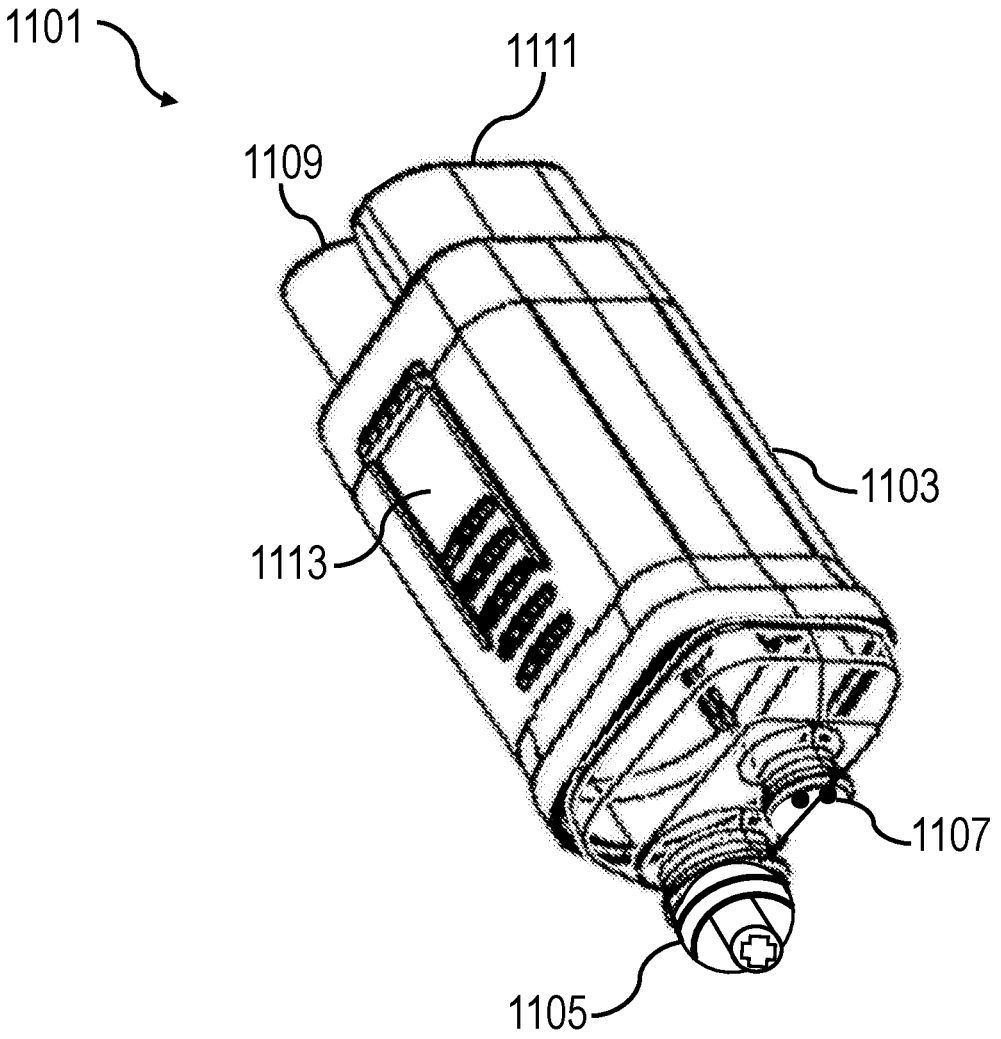
FIG. 11 is a perspective view of an accessory connector, in accordance with some embodiments

FIG. 11 is a perspective view of an accessory connector 1101, in accordance with some embodiments. Accessory connector 1101 comprises an accessory connector body 1103 configured to mate with an accessory receptacle such as accessory receptacle 307 (FIG. 3), a fluid supply coupling 1105 configured to be communicatively coupled with fluid coupling 311 (FIG. 10), and a power supply coupling 1107 configured to be communicatively coupled with electrical contact 309 (FIG. 10).

Accessory connector 1101 additionally includes a fluid supply coupling 1107 configured to be communicatively coupled with a fluid supply line such as fluid supply line 133 of accessory connection package 115 (FIG. 1) that fluidically couples the fluid supply coupling 1105 with an accessory handgrip such as accessory handgrip 117 or an accessory attachment such as accessory attachment 113, and a power supply output 1111 configured to be communicatively coupled with a power supply line such as power supply line 135 of accessory connection package 115 that electrically power supply coupling 1107 with an accessory handgrip such as accessory handgrip 117 or an accessory attachment such as accessory attachment 113.

In use, the accessory connector 1101 is configured to be unitarily inserted into accessory receptacle 307 to enable a singular connection step that connects both the fluid supply coupling 1105 with the fluid coupling 311 and the power supply coupling 1107 with the electrical contact 309. In some embodiments, the accessory connector body 1103 is at least partially accommodated within accessory receptacle 307. In some embodiments, accessory connector body is secured in the accessory receptacle by way of friction and a press fit. In some embodiments, accessory connector body 1103 is secured in accessory receptacle 307 by a connector lock 1113. Connector lock 1113 is configured to hold the accessory connector body 1103 inside accessory receptacle 307 and to release the accessory connector body 1103 from accessory receptacle 307 if connector lock 1113 actuated. In some embodiments, connector lock 1113 comprises a flexible portion of accessory connector body 1103 or some other suitable structure capable of releasably securing the accessory connector body 1103 in accessory receptacle 307.

In some embodiments, fluid supply coupling 1105 comprises a nipple, a shaft, a jet, a tube, or some other suitable structure configured to mate with the fluid coupling 311 for fluidically coupling accessory connector 1101 with body 101. In some embodiments, fluid supply coupling 1105 comprises an o-ring around an external surface to promote a fluid seal between the fluid supply coupling 1105 and the fluid coupling 311. In some embodiment, fluid supply coupling 1105 comprises a double o-ring around an external surface to promote a fluid seal between the fluid supply coupling 1105 and the fluid coupling 311.

Figure 12:
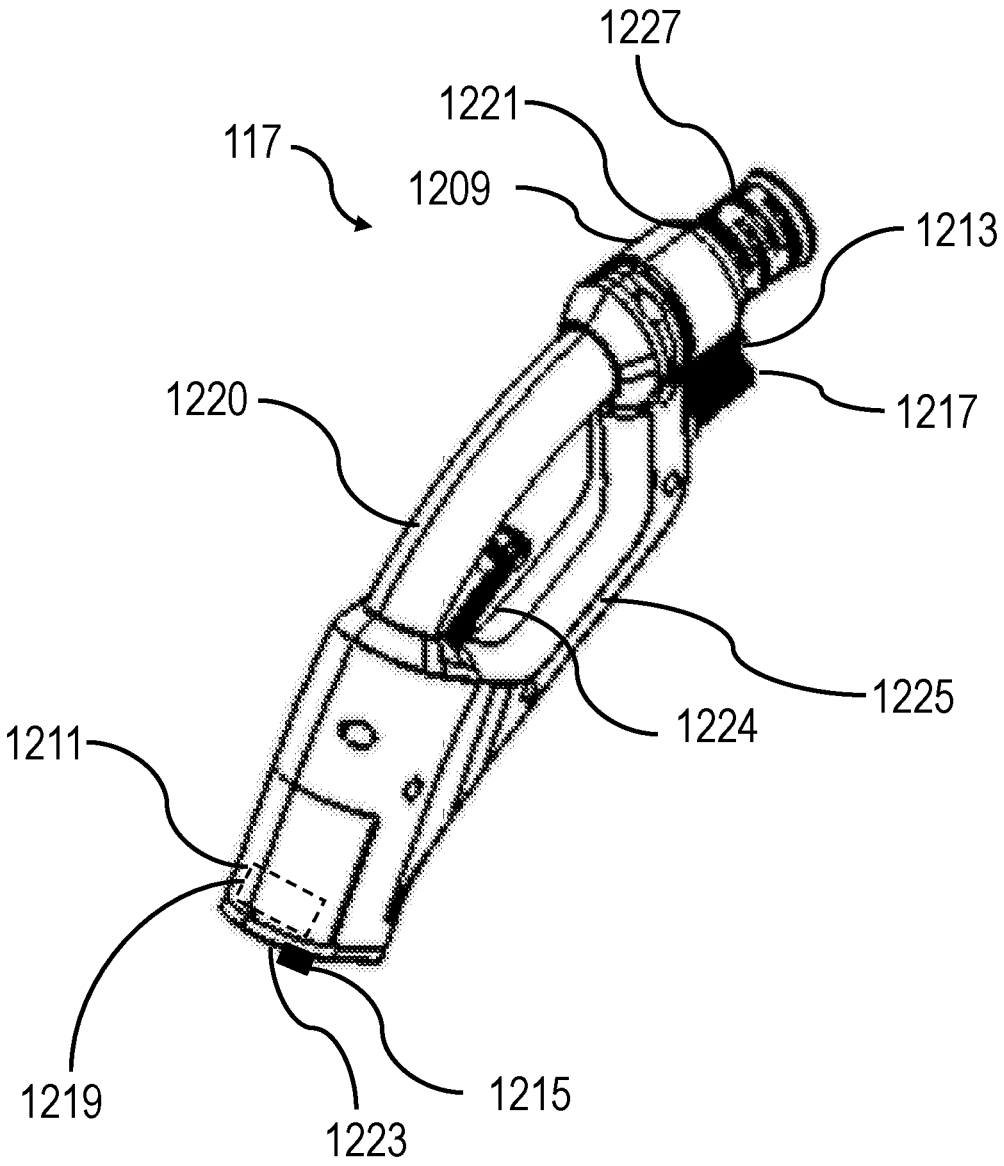
FIG. 12 is a perspective view of an accessory handgrip, in accordance with some embodiments.

FIG. 12 is a perspective view of an accessory handgrip 117, in accordance with some embodiments. Accessory handgrip 117 comprises a first end 1209 and a second end 1211 opposite the first end 1209. A handle fluid input 1213 is on the first end 1209 of the accessory handgrip 117, and a handle fluid output 1215 is on the second end 1211 of the accessory handgrip 117. The handle fluid output 1215 is communicatively coupled with the handle fluid input 1213 by way of a tube, hose, channel, or other suitable structure. The tube, hose, channel, or other suitable structure is internal to the accessory handgrip 117. In some embodiments, the tube, hose, channel, or other suitable structure is external to the accessory handgrip 117.

A first handle electrical contact 1217 is on the first end 1209 of the accessory handgrip 117, and a second handle electrical contact 1219 is on the second end 1211 of the accessory handgrip 117. The second handle electrical contact 1219 is communicatively coupled with the first handle electrical contact 1217 by way of a conductive material between the first handle electrical contact 1217 and the second handle electrical contact 1219. The conductive material is internal to the accessory handgrip 117. In some embodiments, the conductive material is external to the accessory handgrip 117. In some embodiments, the conductive material comprises one or more wires.

A grip portion 1220 is between the first end 1209 and the second end 1211 of the accessory handgrip 117. A first handle air passage 1221 is on the first end 1209 of the accessory handgrip 117, and a second handle air passage 1223 is on the second end 1211 of the accessory handgrip 117. First handle air passage 1221 is communicatively coupled with second handle air passage 1223. In some embodiments, first handle air passage 1221 is communicatively coupled with second handle air passage 1223 by way of a tube, a shaft, a hose, a channel, or some other suitable structure internal to the accessory handgrip 117. In some embodiments, tube, shaft, hose, channel, or other suitable structure is inside the grip portion 1220. In some embodiments, the tube or channel is defined, at least in part, by one or more inner sidewalls of the grip portion 1220. In some embodiments, first handle air passage 1221 is communicatively coupled with second handle air passage 1223 by way of a tube, a shaft, a hose, a channel, or some other suitable structure external to the accessory handgrip 117.

A trigger 1224 is between the first end 1209 and the second end 1211 of the accessory handgrip 117. The trigger 1224 is configured to cause fluid to flow from the handle fluid input 1213 to the handle fluid output 1215. In some embodiments, the trigger 1224 comprises a valve configured to be in an open position if the trigger 1224 is actuated and in a closed position if the trigger 1224 is released. In some embodiments, trigger 1224 is communicatively coupled with a valve configured to be in an open position if the trigger 1224 is actuated and in a closed position if the trigger 1224 is released. In some embodiments, trigger 1224 is coupled with a valve by a mechanical linkage. In some embodiments, trigger 1224 is operatively coupled with a valve, and the actuation of trigger 1224 causes an electrical signal to be communicated to the valve, causing the coupled valve to be in the open or closed position.

In some embodiments, accessory handgrip 117 includes a grip guard 1225 between the first end 1209 of accessory handgrip 117 and the second end 1211 of accessory handgrip 117. The grip guard 1225 is separated from the grip portion 1220. The handle fluid input 1213 is communicatively coupled with the handle fluid output 1215 by way of the grip guard 1225. In some embodiments, the handle fluid output 1215 is communicatively coupled with the handle fluid input 1213 by way of the grip guard 1225. In some embodiments, a tube, hose, channel, or other suitable structure that communicatively couples the handle fluid output 1215 with the handle fluid input 1213 is within the grip guard 1225. In some embodiments, a channel through which fluid flows is defined, at least in part, by one or more inner sidewalls of the grip guard 1225.

Grip portion 1220 has an outer diameter and an inner diameter. An inner sidewall of the grip portion 1220 defines a least a portion of a channel that communicatively couples the first handle air passage 1221 with the second handle air passage 1223. In some embodiments, the inner diameter of the grip portion 1220 is equal to the inner diameter of the hose 131 (FIG. 1). Having a grip portion 1220 with an inner diameter that is equal to the inner diameter of hose 131 makes it possible to facilitate flow of air and/or fluid from the first handle air passage 1221 to the second handle air passage 1223 and into hose 131 without a hose, tube, shaft or pipe, for example, inside the grip portion 1220. By excluding a hose, tube, shaft or pipe from the inside of the grip portion 1220, the outer diameter of the grip portion 1220 is capable of being minimized. A grip portion 1220 that has a minimized outer diameter is capable of being handled by a user that has small hands, for example, in a more comfortable and effective manner than a grip portion that is larger than otherwise necessary to operate the apparatus 100 (FIG. 1) comfortably and effectively. In some embodiments, the outer diameter of the grip portion 1220 is equal to the outer diameter of hose 131.

A hose connector 1227 is attached to the first end 1209 of accessory handgrip 117 and is configured to wrap around a hose such as hose 131 which is communicatively coupled with first handle air passage 1221. Hose connector 1227 is configured to support an end of the hose coupled with accessory handgrip 117 to minimize stress on the hose 131 or the coupling between the first handle air passage 1221 and the attached hose 131 caused by movement of the accessory handgrip 117 or attached hose 131 with respect to the other of the accessory handgrip 117 or the attached hose 131.

Figure 13:
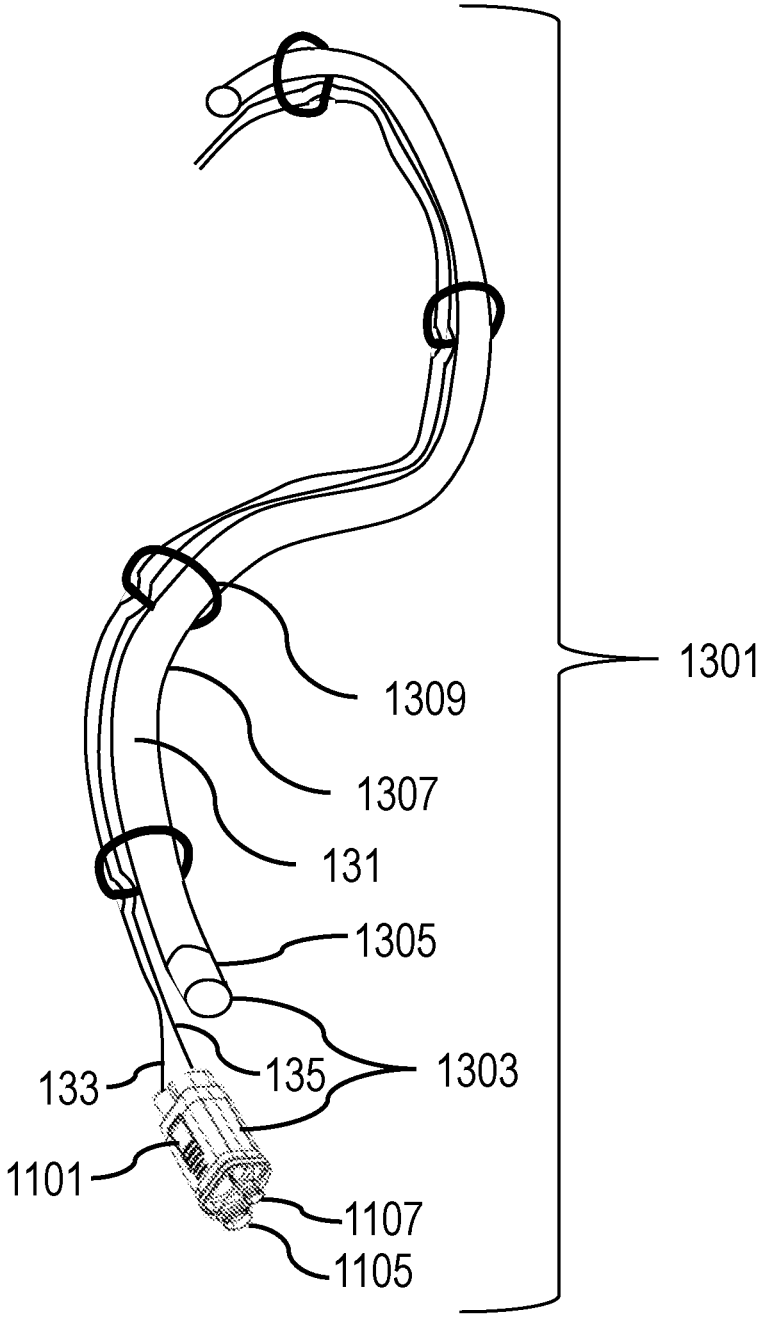
FIG. 13 is a perspective view of an accessory attachment package, in accordance with some embodiments.

FIG. 13 is a perspective view of accessory attachment package 115, in accordance with some embodiments. In some embodiments, accessory attachment package 115 includes an accessory handgrip such as accessory handgrip 117 (FIG. 12). Accessory attachment package 115 comprises a hose 131 configured to be communicatively coupled with the first handle air passage 1221 (FIG. 12), a fluid supply line 133 configured to be communicatively coupled with the handle fluid input 1213 (FIG. 12), a power supply line 135 configured to be communicatively coupled with the first handle electrical contact 1217 (FIG. 12), and an extraction system coupler 1303 comprising a suction port coupling 1305 communicatively coupled with the hose 131 and accessory connector 1101. The fluid supply coupling 1105 of accessory connector 1101 is communicatively coupled with the fluid supply line 133, and the power supply coupling 1107 of accessory connector 1101 is communicatively coupled with the power supply line 135.

Suction port coupling 1305 is configured to mate with the third air passage 409 (FIG. 4) to facilitate suction of one or more of air or fluid through the hose 131 and into recovery tank 105 (FIG. 1). Accessory connector 1101 is configured to facilitate a transfer of electricity from the body 101 (FIG. 1) to the power supply line 135 and a transfer of cleaning fluid from body 101 to the accessory handgrip 117 and/or an accessory attachment such as accessory attachment 113 (FIG. 1). The fluid supply coupling 1105 and the power supply coupling 1107 are included in the accessory connector body 1103 that is separated from the suction port coupling 1305.

The fluid supply line 133 and the power supply line 135 are fastened to an exterior surface 1307 of the hose 131 by a plurality of clasps 1309. Each clasp 1309 is configured to wrap around the hose 131, the fluid supply line 133 and the power supply line 135. In some embodiments, one or more clasps 1309 are configured to accommodate the fluid supply line 133 and the power supply line 135 in a corresponding line seat such that each of the fluid supply line 133 and the power supply line 135 is between each corresponding line seat and the exterior surface 1307 of the hose 131. In some embodiments, the fluid supply line 133 and the power supply line 135 are covered by a sheath that one or more of fastens the fluid supply line 133 and the power supply line 135 to hose 131, or the protects the fluid supply line 133 and the power supply line 135 from external influence or entanglement.

Figure 14:
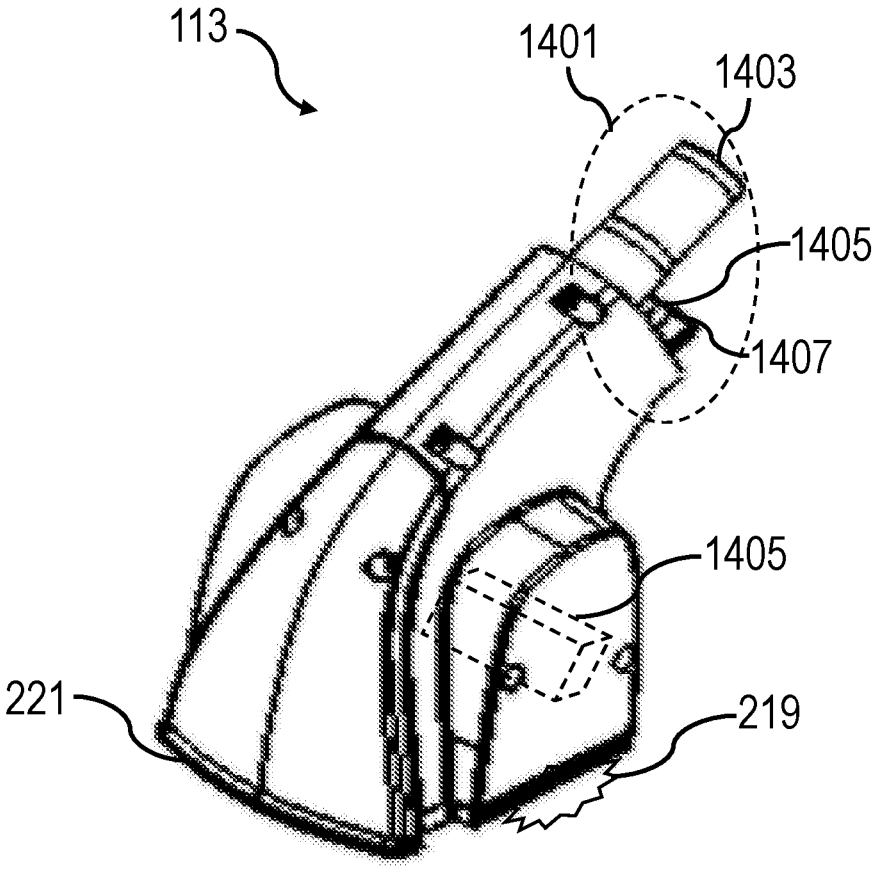
FIG. 14 is a perspective view of an accessory attachment, in accordance with some embodiments.

FIG. 14 is a perspective view of an accessory attachment 113, in accordance with some embodiments. Accessory attachment 113 is a cleaning head configured to be communicatively coupled with by way of an accessory handgrip such as accessory handgrip 117 (FIG. 1). Accessory attachment 113 is an upholstery cleaning head configured to expel fluid supplied by the apparatus 100 (FIG. 1) onto a surface opposite to a bottom of the accessory attachment 113. In some embodiments, accessory attachment 113 is a different type of cleaning head configured interact with a different type of surface such as a grout cleaning head, a hard surface cleaning head, a carpet cleaning head, or some other suitable type of cleaning head.

Accessory attachment 113 is configured to agitate the surface opposite the bottom of the accessory attachment 113 by way of agitator 219 and to draw one of more of air, fluid or debris from the surface opposite the bottom of the accessory attachment 113 into nozzle 221 based on a suction force provided by the vacuum motor inside body 101. The suction force provided by the extraction system 108 causes the one or more of air, fluid or debris to be drawn through the nozzle of accessory attachment 113 into the handle air passages and the hose with which the accessory attachment 113 is attached.

The accessory attachment 113 comprises an accessory coupling 1401 comprising an accessory air passage 1403, an accessory fluid coupling 1405, and an accessory electrical coupling 1407 configured to mate with the second end 1211 of the accessory handgrip 117. The accessory coupling 1401 is configured to facilitate transfer of fluid from the accessory handgrip 117 to an attached accessory attachment 113, supply electricity to the attached accessory attachment 113, and link the accessory air passage 1403 of the attached accessory attachment 113 with the first handle air passage 1221.

Accessory attachment 113 includes one or more sidewalls that define an accessory body having a cavity defined therein. Nozzle 221 is communicatively coupled with the accessory air passage 1403 through the accessory body by way of one or more of a tube, a shaft, a hose, a channel, or some other suitable structure.

Agitator 219 comprises one or more of a brush, a spin brush, a rotary brush, a blade, or some other suitable structure. Agitator motor 1409 is communicatively coupled with the accessory electrical coupling 1407. The agitator motor 1409 is configured to cause the agitator 219 to move based on electricity received by way of the second handle electrical contact 1219 (FIG. 12). In some embodiments, agitator motor 1409 is configured to cause the agitator 219 to move in a direction toward nozzle 221. In some embodiments, agitator motor 1409 is configured to cause the agitator 219 to move in a direction away from nozzle 221.

Figure 15:
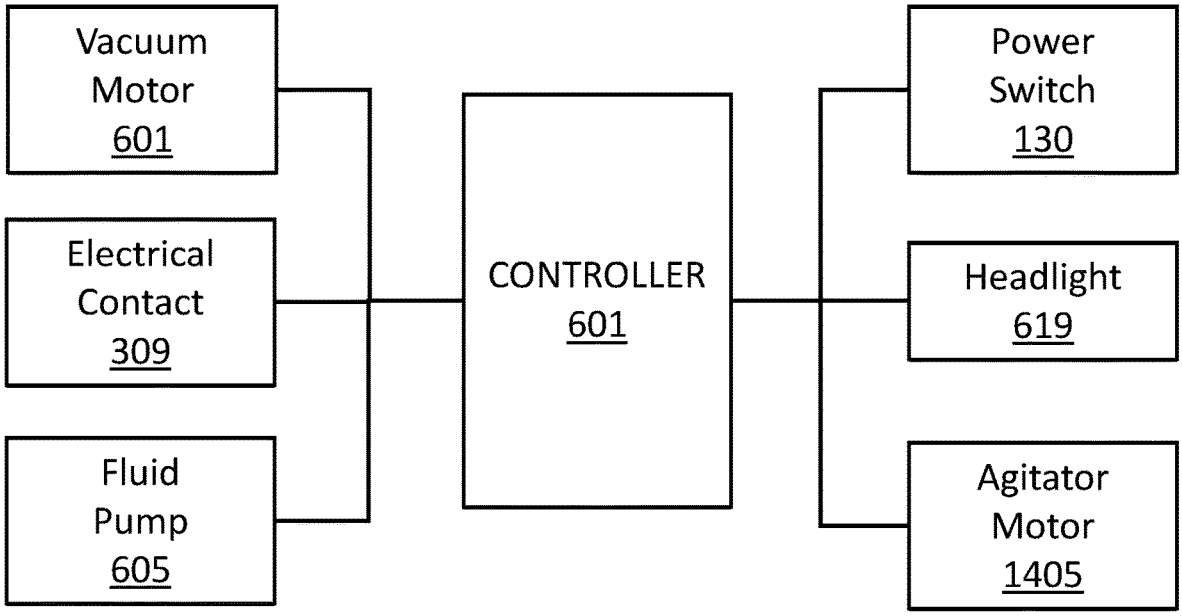
FIG. 15 is a schematic diagram of a control system, in accordance with some embodiments.

FIG. 15 is a schematic diagram of a control system 1500, in accordance with some embodiments. Control system 1500 comprises controller 601 communicatively coupled with vacuum motor 603, agitator motor 1409, fluid pump 605, electrical contact 309, power button 130, and a headlight 619.

Controller 601 is configured to turn the vacuum motor 603 on or off based on a position of power button 130. Controller 601 is configured to one or more of cause power to be supplied to the agitator motor 1409 or output an instruction to the agitator motor 1409 based on the position of the power button 130 or a position of trigger 1224 (FIG. 12) of accessory handgrip 117 (FIG. 12). In some embodiments, the controller 601 is configured to cause power to be supplied to the electrical contact 309 based on the position of the power button 130.

In some embodiments, controller 601 is configured to cause fluid to flow from the cleaning fluid tank 103 (FIG. 1) to the fluid coupling 311 (FIG. 3) by way of the body fluid coupling 401 (FIG. 4) of body 101 based on a position of the power button 130 and an actuation of trigger 1224.

Figure 16:
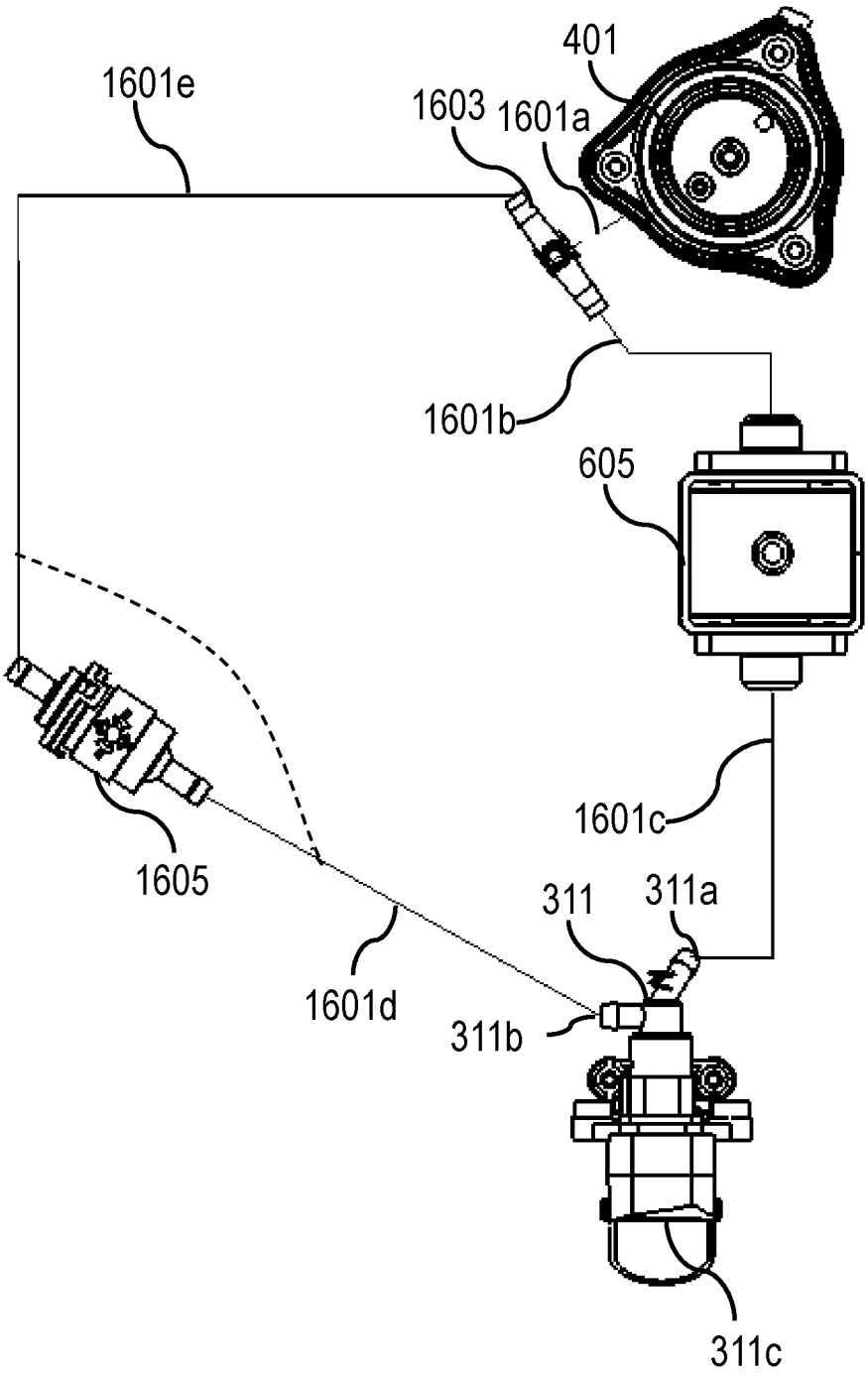
FIG. 16 is a diagram of a fluid flow system, in accordance with some embodiments.

FIG. 16 is a diagram of a fluid flow system 1600, in accordance with some embodiments. Fluid flow system 1600 includes a plurality of fluid flow paths 1601*a*-1601*e* that communicatively couple the body fluid coupling 401, the fluid pump 605, and the fluid coupling 311.

By way of example, fluid flow paths 1601*a*-1601*e* communicatively couple body fluid coupling 401, three-way connector 1603, fluid pump 605, fluid coupling 311, and check valve 1605. Each fluid flow path 1601*a*-1601*e* comprises one or more of a tube, a hose, a pipe, a nozzle, a valve, a fluid coupler, or some other suitable via through which fluid is capable of moving.

Fluid pump 605 is communicatively coupled with a controller of apparatus 100, such as controller 601 (FIG. 6). In use, fluid pump 605 causes cleaning fluid to be drawn from fluid flow path 1601*b*. The cleaning fluid drawn from fluid flow path 1601*b* comprises one or more of cleaning fluid directly drawn from cleaning fluid tank 103 (FIG. 1) by way of body fluid coupling 401, fluid flow path 1601*a*, and three-way connector 1603, or cleaning fluid that was drawn from cleaning fluid tank 103, circulated through fluid flow paths 1601*b*, 1601*c*, 1601*d*, and 1601*e*, and received by thee three-way connector 1603.

The cleaning fluid drawn from cleaning fluid tank 103 is drawn into an inlet of fluid pump 605 and output to fluid flow path 1601*c* from an outlet of fluid pump 605.

An inlet 311*a* of fluid coupling 311 is communicatively coupled with fluid flow path 1601*c*. A fluid system outlet 311*b* of fluid coupling 311 is communicatively coupled with fluid flow path 1601*d*. In use, if a fluid connector such as the fluid connector 311 of accessory connector 1101 is not coupled with fluid coupling 311, the fluid coupling 311 is configured to cause cleaning fluid to flow from fluid flow path 1601*c* to fluid flow path 1601*d*. If an accessory connector is coupled with fluid coupling 311, the fluid coupling 311 is configured to allow cleaning fluid to flow out of an accessory fluid output 311*c* and into an accessory attachment that is coupled with apparatus 100 by way of fluid coupling 311.

An inlet of check valve 1605 is communicatively coupled with the output of fluid coupling 311 by way of fluid flow path 1601*d*. An outlet of check valve 1605 is communicatively coupled with three-way connector 1603 by way of fluid flow path 1601*e*. In use, if the fluid coupling 311 is free from being coupled with an accessory connector, cleaning fluid output by fluid pump 605 is caused to flow into fluid flow path 1601*d*. If pressure builds in fluid flow path 1601*d* to a point that a threshold pressure is breached, the check valve 1605 will open to cause cleaning fluid to flow into fluid flow path 1601*e*.

In some embodiments, if the fluid coupling 311 is coupled with an accessory connector, check valve 1605 is configured to allow pressure to build within fluid flow path 1601*d* to a point that fluid coupling 311 causes cleaning fluid to flow into an attached accessory by way of accessory fluid outlet 1613*c*. If the attached accessory is in a state in which cleaning fluid is not being output by the accessory, pressure continues to build in fluid flow path 1601*d* until the threshold pressure is reached. Upon reaching the threshold pressure with the accessory attached to the fluid coupling 311, check valve 1605 will open to cause cleaning fluid to flow into fluid flow path 1601*e*.

Three-way connector 1603 is configured to receive cleaning fluid from fluid flow path 1601*a* and fluid flow path 1601*e*. In some embodiments, three-way connector 1603 is configured to output fluid received from fluid flow path 1601*a*, fluid flow path 1601*e* or a mixture thereof to fluid flow path 1601*b*. In some embodiments, three-way connector 1603 is a valve. In some embodiments, three-way connector is reliant on pressure in fluid flow path 1601*e* resulting from fluid pump 605, for example, or pressure in fluid flow path 1601*a* caused by the relative height of the cleaning fluid in cleaning fluid tank 103 with respect to three-way connector 1603, for example, to facilitate whether fluid pump 605 will receive cleaning fluid directly drawn from cleaning fluid tank 103, recirculated cleaning fluid that was drawn from cleaning fluid tank 103, or some combination thereof.

In some embodiments, check valve 1605 is included in three-way connector 1603, and fluid flow paths 1601*d* and 1601*e* are a continuous path free from having an intermediary component between fluid coupling 311 and three-way connector 1603.

In some embodiments, fluid coupling 311 comprises a fluid diverter, valve or other suitable structure configured to direct fluid flow from the inlet 311 a of fluid coupling 311 to the accessory fluid output 311*c* based on the accessory fluid coupling being coupled with an accessory such that the flow of fluid into the attached accessory is free from being reliant on back pressure from check valve 1605. In some embodiments, fluid pump 605 is configured to turn off if a fluid pressure in at least fluid flow path 1601*c* is greater than a predetermined threshold.

Figure 17:
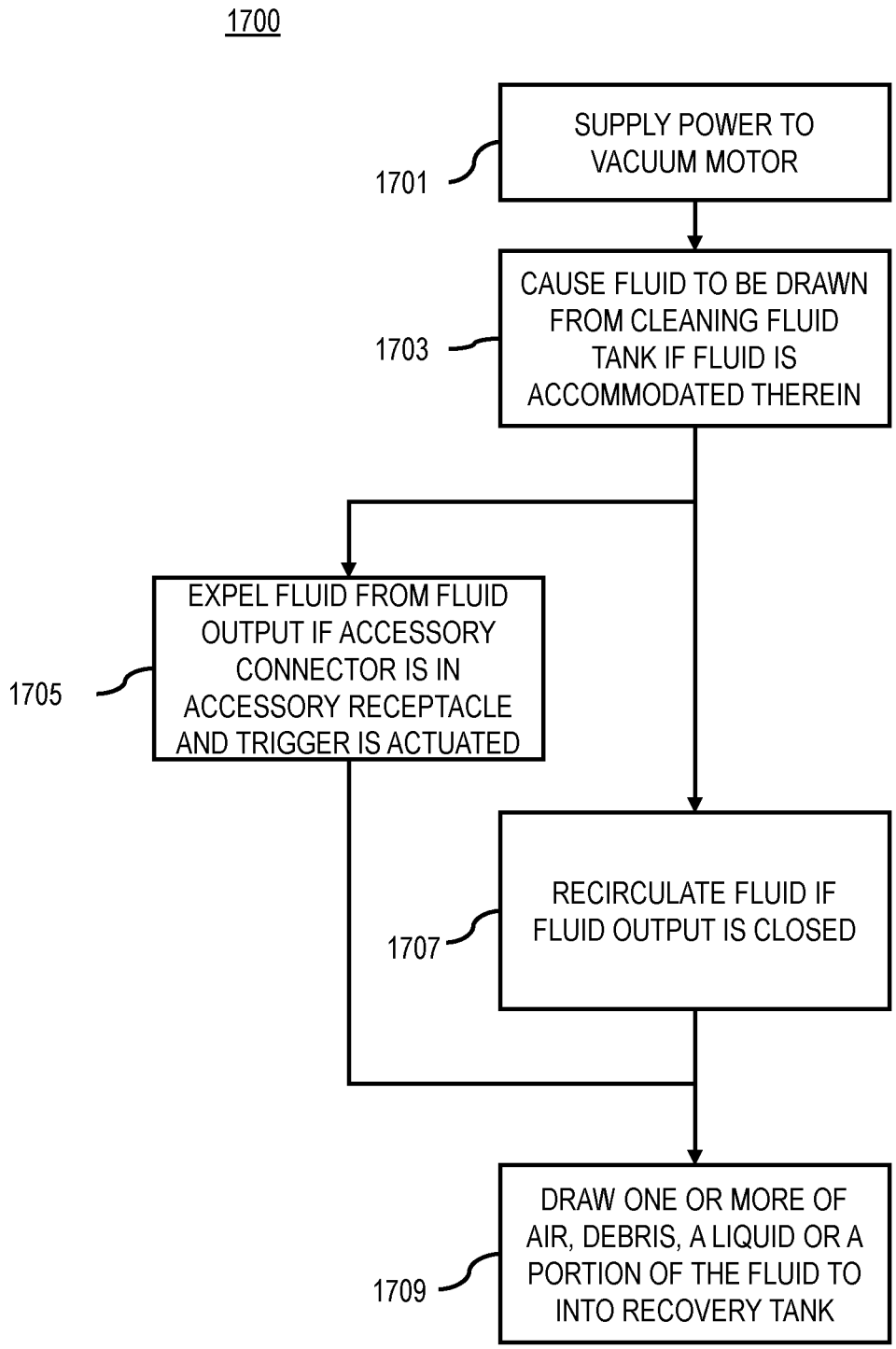
FIG. 17 is a flowchart of a method, in accordance with some embodiments.

FIG. 17 is a flowchart of a method 1700, in accordance with some embodiments. In some embodiments, one or more steps of method 1700 is implemented by apparatus 100 (FIG. 1) or a processor included in processor-based system 1800 (FIG. 18).

In step 1701, a controller causes power to be supplied to a vacuum motor based on a switch being in a first operation position or a second operation position.

In step 1703, a fluid accommodated by a cleaning fluid tank is drawn from the cleaning fluid tank based on the switch being in the first operation position or the second operation position.

In step 1705, the fluid drawn from the cleaning fluid tank is expelled from a fluid outlet of an accessory attachment based on coupling between an accessory connector and a fluid coupling of the apparatus, and an actuation of a trigger configured to allow fluid to flow into the accessory attachment. In some embodiments, an agitator motor communicatively coupled with the controller and configured to cause an agitator of the accessory attachment to move is activated if the switch is in the first operation position. In some embodiments, the controller causes the agitator motor to move the agitator if the switch is in the first position and the trigger is actuated. In some embodiments, the controller detects whether the agitator motor is capable of causing the agitator to move, for example is the agitator is jammed, while the agitator motor is activated and the switch is in the first operation position. If the agitator is incapable of moving, the controller causes one or more of the agitator motor, the vacuum motor or a fluid pump that draws the fluid from the cleaning fluid tank to be inactivated while the switch is in the first operation position.

In step 1707, fluid drawn from the cleaning tank is recirculated to the fluid pump if the switch is in the first operation position and one or more of the fluid coupling is closed the accessory connector is not coupled with the fluid coupling, or the trigger configured to cause fluid to be expelled by the accessory attachment is not actuated.

In step 1709 the vacuum motor causes one or more of air, debris, a liquid or a portion of the fluid to be drawn into a recovery tank separate from the cleaning fluid tank.

FIG. 18 is a functional block diagram of a computer or processor-based system 1800 upon which or by which an embodiment is implemented.

Processor-based system 1800 is programmed to cause a fluid extraction system such as apparatus 100 to operate as described herein, and includes, for example, bus 1801, processor 1803, and memory 1805 components.

In some embodiments, the processor-based system 1800 is implemented as a single "system on a chip." Processor-based system 1800, or a portion thereof, constitutes a mechanism for performing one or more steps of operating a liquid extraction system.

In some embodiments, the processor-based system 1800 includes a communication mechanism such as bus 1801 for transferring information and/or instructions among the components of the processor-based system 1800. Processor 1803 is connected to the bus 1801 to obtain instructions for execution and process information stored in, for example, the memory 1805. In some embodiments, the processor 1803 is also accompanied with one or more specialized components to perform certain processing functions and tasks such as one or more digital signal processors (DSP), or one or more application-specific integrated circuits (ASIC). A DSP typically is configured to process real-world signals (e.g., sound) in real time independently of the processor 1803. Similarly, an ASIC is configurable to perform specialized functions not easily performed by a more general purpose processor. Other specialized components to aid in performing the functions described herein optionally include one or more field programmable gate arrays (FPGA), one or more controllers, or one or more other special-purpose computer chips.

In one or more embodiments, the processor (or multiple processors) 1803 performs a set of operations on information as specified by a set of instructions stored in memory 1805 related to operating a liquid extraction system. The execution of the instructions causes the processor to perform specified functions.

The processor 1803 and accompanying components are connected to the memory 1805 via the bus 1801. The memory 1805 includes one or more of dynamic memory (e.g., RAM, magnetic disk, writable optical disk, etc.) and static memory (e.g., ROM, CD-ROM, etc.) for storing executable instructions that when executed perform the steps described herein to operate a liquid extraction system. The memory 1805 also stores the data associated with or generated by the execution of the steps.

In one or more embodiments, the memory 1805, such as a random access memory (RAM) or any other dynamic storage device, stores information including processor instructions for operating a liquid extraction system. Dynamic memory allows information stored therein to be changed by system 1800. RAM allows a unit of information stored at a location called a memory address to be stored and retrieved independently of information at neighboring addresses. The memory 1805 is also used by the processor 1803 to store temporary values during execution of processor instructions. In various embodiments, the memory 1805 is a read only memory (ROM) or any other static storage device coupled to the bus 1801 for storing static information, including instructions, that is not changed by the system 1800. Some memory is composed of volatile storage that loses the information stored thereon when power is lost. In some embodiments, the memory 1805 is a non-volatile (persistent) storage device, such as a magnetic disk, optical disk or flash card, for storing information, including instructions, that persists even when the system 1800 is turned off or otherwise loses power.

The term "computer-readable medium" as used herein refers to any medium that participates in providing information to processor 1803, including instructions for execution. Such a medium takes many forms, including, but not limited to computer-readable storage medium (e.g., non-volatile media, volatile media). Non-volatile media includes, for example, optical or magnetic disks. Volatile media include, for example, dynamic memory. Common forms of computer-readable media include, for example, a floppy disk, a flexible disk, a hard disk, a magnetic tape, another magnetic medium, a CD-ROM, CDRW, DVD, another optical medium, punch cards, paper tape, optical mark sheets, another physical medium with patterns of holes or other optically recognizable indicia, a RAM, a PROM, an EPROM, a FLASH-EPROM, an EEPROM, a flash memory, another memory chip or cartridge, or another medium from which a computer can read. The term computer-readable storage medium is used herein to refer to a computer-readable medium.

An aspect of this description is related to an apparatus comprising a body, a first tank, a second tank, a vacuum motor, a fluid pump, and a controller. The body comprises a handle, a first fluid coupling, a first air passage, a second air passage, and an accessory connection receptacle comprising a fluid output and an electrical contact. The first tank is on a first side of the handle. The first tank comprises a first vessel configured to accommodate a fluid, and a second fluid coupling communicatively coupled with the first fluid coupling. The second tank is on a second side of the handle. The second tank comprises a second vessel separated from the first vessel, a third air passage communicatively coupled with the first air passage, and a fourth air passage communicatively coupled with the second air passage. The vacuum motor has an inlet communicatively coupled with the second air passage by way of the second tank. The fluid pump is communicatively coupled with the first fluid coupling and the fluid output. The controller is communicatively coupled with the vacuum motor, the fluid pump, and the electrical contact. The controller is configured to activate the fluid pump to cause fluid contained in the first tank to be supplied to the fluid output, and to activate the vacuum motor to draw one or more of air, debris, a liquid or a portion of the fluid into the second tank by way of the second air passage. The accessory connection receptacle is configured to accommodate a correspondingly shaped accessory connector configured to mate with the accessory connection receptacle and be communicatively coupled with the fluid output and with the electrical contact.

Another aspect of this description is related to an apparatus comprising a body, a first tank, a second tank, a vacuum motor, a fluid pump, a controller, and an accessory connection package. The body comprises a first fluid coupling, a first air passage, a second air passage, an accessory connection receptacle comprising a fluid output and an electrical contact, and an accessory connection air passage separate from the accessory connection receptacle and communicatively coupled with the second air passage. The first tank is on a first side of the body. The first tank comprises a first vessel configured to accommodate a fluid and a second fluid coupling communicatively coupled with the first fluid coupling. The second tank is on a second side of the body. The second tank comprises a second vessel separated from the first vessel, a third air passage communicatively coupled with the first air passage, and a fourth air passage communicatively coupled with the second air passage. The vacuum motor has an inlet communicatively coupled with the second air passage by way of the second tank. The fluid pump is communicatively coupled with the first fluid coupling and the fluid output. The controller is communicatively coupled with the vacuum motor, the fluid pump, and the electrical contact. The controller is configured to activate the fluid pump to cause fluid contained in the first tank to be supplied to the fluid output, and to activate the vacuum motor to draw one or more of air, debris, a liquid or a portion of the fluid into the second tank by way of the accessory connection air passage. The accessory connection package comprises a hose, a fluid supply line, a power supply line, an accessory connector coupled with the fluid supply line and the power supply line, and an accessory handgrip. The accessory handgrip has a fluid coupling communicatively coupled with the fluid supply line, an electrical coupling communicatively coupled with the power supply line, and a handgrip air passage communicatively coupled with the hose. The accessory connector is configured to mate with the accessory connection receptacle and be communicatively coupled with the fluid output and with the electrical contact. The hose is configured to be communicatively coupled with the accessory connection air passage.

A further aspect of this description is related to apparatus comprising a body, a first tank, a second tank, a vacuum motor, a fluid pump, a controller, and an accessory connection package. The body comprises a first fluid coupling, a first air passage, a second air passage, an accessory connection receptacle comprising a fluid output and an electrical contact, and an accessory connection air passage separate from the accessory connection receptacle and communicatively coupled with the second air passage. The first tank is on a first side of the body. The first tank comprises a first vessel configured to accommodate a fluid, and a second fluid coupling communicatively coupled with the first fluid coupling. The second tank is on a second side of the body. The second tank comprises a second vessel separated from the first vessel. The second vessel has a third air passage configured to be communicatively coupled with the first air passage, and a fourth air passage configured to be communicatively coupled with the second air passage. Each of the third air passage and the second air passage is configured to facilitate airflow into and out of a cavity within the second vessel. The vacuum motor has an inlet communicatively coupled with the second air passage by way of the second tank. The fluid pump is communicatively coupled with the first fluid coupling and the fluid output. The controller is communicatively coupled with the vacuum motor, the fluid pump, and the electrical contact. The controller is configured to activate the fluid pump to cause fluid contained in the first tank to be supplied to the fluid output, and to activate the vacuum motor to draw one or more of air, debris, a liquid or a portion of the fluid into the second tank by way of the accessory connection air passage. The accessory connection package comprises a hose, a fluid supply line, a power supply line, an accessory connector coupled with the fluid supply line and the power supply line, and an accessory handgrip. The accessory handgrip comprises a fluid coupling communicatively coupled with the fluid supply line, an electrical coupling communicatively coupled with the power supply line, and a handgrip air passage communicatively coupled with the hose. The accessory connector is configured to mate with the accessory connection receptacle to communicatively couple the fluid output with the fluid supply line and communicatively coupled the electrical contact with the power supply line. The hose is configured to be communicatively coupled with the accessory connection air passage to communicatively couple the handgrip air passage with the accessory connection air passage.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure. As such, although features of several embodiments are expressed in certain combinations among the foregoing description and claims, the features or steps discussed with respect to some embodiments can be arranged in any combination or order.

What is claimed is:

1. An apparatus, comprising:

a body comprising:
- a handle;
- a first fluid coupling;
- a first air passage;
- a second air passage; and
- an accessory connection receptacle comprising a fluid output and an electrical contact;

a first tank on a first side of the handle, the first tank comprising:
- a first vessel configured to accommodate a fluid; and
- a second fluid coupling communicatively coupled with the first fluid coupling;

a second tank on a second side of the handle, the second tank comprising:
- a second vessel separated from the first vessel;
- a third air passage communicatively coupled with the first air passage; and
- a fourth air passage communicatively coupled with the second air passage;

a vacuum motor having an inlet communicatively coupled with the second air passage by way of the second tank;

a fluid pump communicatively coupled with the first fluid coupling and the fluid output;

a controller communicatively coupled with the vacuum motor, the fluid pump, and the electrical contact, the controller being configured to activate the fluid pump to cause fluid contained in the first tank to be supplied to the fluid output, and to activate the vacuum motor to draw one or more of air, debris, a liquid or a portion of the fluid into the second tank by way of the second air passage; and a hose rack, comprising:
- a base extending from a side surface of the body; and
- a panel on an end of the base opposite to the body, wherein the panel is configured to hold a hose wrapped around the base in a space between the panel and the body, wherein
- the accessory connection receptacle is configured to accommodate a correspondingly shaped accessory connector having a unitary structure configured to mate with the accessory connection receptacle and be communicatively coupled with the fluid output and with the electrical contact, and
- the accessory connection receptacle is on the base of the hose rack.

2. The apparatus of claim 1, wherein the panel is x-shaped.

3. The apparatus of claim 1, further comprising:

a holster on a surface of the panel opposite to a surface of the panel facing the body, wherein the holster having at least one sidewall defining a cavity configured to accommodate an accessory handgrip so as to releasably hold at least a portion of the accessory handgrip in the cavity.

4. The apparatus of claim 3, wherein the holster is configured to hold the accessory handgrip such that a fluid output of the accessory handgrip faces a bottom of the cavity, and the at least sidewall defining the cavity has one or more drain holes at the bottom of the cavity.

5. The apparatus of claim 3, wherein the body further comprises a sidewall defining recessed region configured to releasably hold an accessory attachment configured to be communicatively coupled with the accessory handgrip.

6. The apparatus of claim 5, further comprising an accessory cradle cap comprising a sidewall that, when coupled with the body, defines an accessory cradle configured to accommodate at least a portion of the accessory attachment.

7. The apparatus of claim 5, wherein the recessed region has a shape that substantially matches a shape of the accessory attachment.

8. The apparatus of claim 5, wherein the sidewall defining the recessed region is on a side of the body opposite to the hose rack.

9. The apparatus of claim 1, wherein the hose rack comprises a fifth air passage on the base of the hose rack, the fifth air passage is communicatively coupled with the second air passage, and the fifth air passage is configured to be communicatively coupled with a hose.

10. The apparatus of claim 9, wherein the fifth air passage is on a side of the base opposite to a side of the base having the accessory connection receptacle.

11. The apparatus of claim 9, further comprising a hose communicatively coupled with the fifth air passage, a fluid supply line communicatively coupled with the fluid output, a power supply line communicatively coupled with the electrical contact, and an accessory handgrip having a fluid coupling communicatively coupled with the fluid output, an electrical coupling communicatively coupled with the power supply line, and a handgrip air passage communicatively coupled with the hose.

12. The apparatus of claim 11, further comprising an accessory attachment configured to be releasably attached to the accessory handgrip, the accessory attachment being configured to receive fluid from the fluid output by way of the accessory handgrip, receive electricity from the electrical contact by way of the accessory handgrip, and draw one or more of air, debris, a liquid or a portion of the fluid into an accessory handgrip air passage based on a suction force supplied by the vacuum motor.

13. The apparatus of claim 12, wherein the accessory attachment comprises:

a fluid outlet configured to eject fluid onto a surface external to the accessory attachment based on an actuation of a trigger included in the accessory handgrip;

an attachment air passage configured to be communicatively coupled with the handgrip air passage; and a nozzle communicatively coupled with the attachment air passage, wherein the accessory attachment is configured to draw the one or more of air, debris, a liquid or a portion of the fluid into the accessory handgrip air passage by way of the nozzle.

14. The apparatus of claim 13, wherein the accessory attachment further comprises:

an accessory electrical contact configured to be communicatively coupled with the electrical coupling;

an agitator motor communicatively coupled with the accessory electrical contact; and an agitator communicatively coupled with the agitator motor, wherein the agitator motor is configured to cause the agitator to move based on one or more of an instruction received from the controller or electricity supplied to the agitator motor by way of the accessory handgrip.

15. The apparatus of claim 14, wherein the agitator is a spin brush configured to move in a direction toward the nozzle.

16. The apparatus of claim 1, wherein the handle comprises a neck portion and a grip portion at an end of the neck portion, the handle configured to be movable from a collapsed position and an extended position, the neck portion is substantially within a cavity defined by one or more sidewalls of the body and the grip portion is external to the cavity defined by the one or more sidewalls of the body if the handle is in the collapsed position, and the neck portion is substantially external to the cavity defined by one or more sidewalls of the body if the handle is in the extended position.

17. An apparatus, comprising:

a body comprising:

a first fluid coupling;

a first air passage;

a second air passage; and an accessory connection receptacle comprising a fluid output and an electrical contact;

an accessory connection air passage separate from the accessory connection receptacle and communicatively coupled with the second air passage;

a first tank on a first side of the body, the first tank comprising:

a first vessel configured to accommodate a fluid; and a second fluid coupling communicatively coupled with the first fluid coupling;

a second tank on a second side of the body, the second tank comprising:

a second vessel separated from the first vessel;

a third air passage communicatively coupled with the first air passage; and a fourth air passage communicatively coupled with the second air passage;

a vacuum motor having an inlet communicatively coupled with the second air passage by way of the second tank;

a fluid pump communicatively coupled with the first fluid coupling and the fluid output;

a controller communicatively coupled with the vacuum motor, the fluid pump, and the electrical contact, the controller being configured to activate the fluid pump to cause fluid contained in the first tank to be supplied to the fluid output, and to activate the vacuum motor to draw one or more of air, debris, a liquid or a portion of the fluid into the second tank by way of the accessory connection air passage;

a hose rack, comprising:

a base extending from a side surface of the body; and a panel on an end of the base opposite to the body, wherein the panel is configured to hold a hose wrapped around the base in a space between the panel and the body; and an accessory connection package comprising a hose, a fluid supply line, a power supply line, an accessory connector coupled with the fluid supply line and the power supply line, and an accessory handgrip having a fluid coupling communicatively coupled with the fluid supply line, an electrical coupling communicatively coupled with the power supply line, and a handgrip air passage communicatively coupled with the hose, wherein the accessory connector is a unitary structure configured to mate with the accessory connection receptacle and be communicatively coupled with the fluid output and with the electrical contact, and the hose is configured to be communicatively coupled with the accessory connection air passage, and the accessory connection receptacle is on the base of the hose rack.

18. An apparatus, comprising:

a body comprising:

a first fluid coupling;

a first air passage;

a second air passage;

an accessory connection receptacle comprising a fluid output and an electrical contact; and an accessory connection air passage separate from the accessory connection receptacle and communicatively coupled with the second air passage;

a first tank on a first side of the body, the first tank comprising:

a first vessel configured to accommodate a fluid; and a second fluid coupling communicatively coupled with the first fluid coupling;

a second tank on a second side of the body, the second tank comprising:

a second vessel separated from the first vessel, the second vessel having a third air passage configured to be communicatively coupled with the first air passage, and a fourth air passage configured to be communicatively coupled with the second air passage, each of the third air passage and the second air passage being configured to facilitate airflow into and out of a cavity within the second vessel;

a vacuum motor having an inlet communicatively coupled with the second air passage by way of the second tank;

a fluid pump communicatively coupled with the first fluid coupling and the fluid output;

a controller communicatively coupled with the vacuum motor, the fluid pump, and the electrical contact, the controller being configured to activate the fluid pump to cause fluid contained in the first tank to be supplied to the fluid output, and to activate the vacuum motor to draw one or more of air, debris, a liquid or a portion of the fluid into the second tank by way of the accessory connection air passage;

a hose rack, comprising:

a base extending from a side surface of the body; and a panel on an end of the base opposite to the body, wherein the panel is configured to hold a hose wrapped around the base in a space between the panel and the body; and an accessory connection package comprising a hose, a fluid supply line, a power supply line, an accessory connector coupled with the fluid supply line and the power supply line, and an accessory handgrip having a fluid coupling communicatively coupled with the fluid supply line, an electrical coupling communicatively coupled with the power supply line, and a handgrip air passage communicatively coupled with the hose, wherein the accessory connector is a unitary structure configured to mate with the accessory connection receptacle to communicatively couple the fluid output with the fluid supply line and communicatively coupled the electrical contact with the power supply line, and the hose is configured to be communicatively coupled with the accessory connection air passage to communicatively couple the handgrip air passage with the accessory connection air passage, and the accessory connection receptacle is on the base of the hose rack.

* * * * *